US008916757B2

(12) United States Patent
Tsuchimoto et al.

(10) Patent No.: US 8,916,757 B2
(45) Date of Patent: Dec. 23, 2014

(54) LID OPENING/CLOSING MECHANISM FOR KEYBOARD MUSICAL INSTRUMENT

(75) Inventors: Sayo Tsuchimoto, Hamamatsu (JP); Hiroki Nakaya, Hamamatsu (JP); Hiromi Negi, Hamamatsu (JP)

(73) Assignee: Yamaha Corporation (JP)

( * ) Notice: Subject to any disclaimer, the term of this patent is extended or adjusted under 35 U.S.C. 154(b) by 361 days.

(21) Appl. No.: 13/543,130

(22) Filed: Jul. 6, 2012

(65) Prior Publication Data

US 2013/0008296 A1 Jan. 10, 2013

(30) Foreign Application Priority Data

Jul. 7, 2011 (JP) ..... 2011-151236
Jul. 7, 2011 (JP) ..... 2011-151237

(51) Int. Cl.
*G10C 1/00* (2006.01)
*G10H 1/32* (2006.01)
*G10C 3/02* (2006.01)

(52) U.S. Cl.
CPC ... *G10C 3/02* (2013.01); *G10H 1/32* (2013.01)
USPC ..... 84/179

(58) Field of Classification Search
USPC ..... 84/2, 7, 174, 179, 436, 438
See application file for complete search history.

(56) References Cited

U.S. PATENT DOCUMENTS 5,175,386 A 12/1992 Kuwahara
2002/0125087 A1 9/2002 Namiki et al.
2003/0221537 A1* 12/2003 Hara ..... 84/179
2007/0157794 A1 7/2007 Suzuki et al.
2008/0066605 A1 3/2008 Ooi

FOREIGN PATENT DOCUMENTS

CN 101000760 A 7/2007
CN 101145339 A 3/2008
JP 3-119891 U 12/1991
JP 11-305757 A 11/1999
JP 2001-349364 A 12/2001
JP 2004-020576 A 1/2004
JP 2008-185215 A 8/2008

OTHER PUBLICATIONS

Chinese Office Action for corresponding CN201210236804.2, dated Feb. 8, 2014. English translation provided.

* cited by examiner

*Primary Examiner* — Kimberly Lockett
(74) *Attorney, Agent, or Firm* — Rossi, Kimms & McDowell LLP

(57) ABSTRACT

A lid opening/closing mechanism for a keyboard musical instrument, including: a main body including a casing and a keyboard; a lid attached to the casing so as to be movable between a closed position for covering the keyboard and an open position for uncovering the keyboard; and a connecting mechanism for connecting a side wall portion in the casing and an end portion of the lid and opposed to the side wall portion, wherein the connecting mechanism is configured such that, during a movement of the lid from the closed position to the open position, a rear end portion of the lid slidingly moves only in a direction from a rear end portion of the main body toward a front end portion thereof or moves in the direction from the rear end portion of the main body toward the front end portion thereof and in an upward direction.

20 Claims, 17 Drawing Sheets

X ENLARGED

LID OPENING/CLOSING MECHANISM FOR KEYBOARD MUSICAL INSTRUMENT

CROSS REFERENCE TO RELATED APPLICATION

The present application claims priority from Japanese Patent Applications Nos. 2011-151236 and 2011-151237, which were filed on Jul. 7, 2011, the disclosure of which is herein incorporated by reference in its entirety.

BACKGROUND OF THE INVENTION

1. Field of the Invention

The present invention relates to a lid opening/closing mechanism for a keyboard musical instrument comprising: a lid configured to be opened and closed so as to uncover and cover a keyboard disposed in a casing; and a connecting mechanism configured to movably connect the lid to the casing.

2. Description of Related Art

Various keyboard musical instruments such as electronic organs and electronic pianos have a keyboard lid or a fall board configured to be opened and closed so as to uncover and cover a keyboard disposed in a casing. As a conventional technique of an opening/closing mechanism for opening and closing the keyboard lid, there is known an opening/closing mechanism disclosed in the following Patent Literature 1. The disclosed opening/closing mechanism has the following structure. That is, a main body of a musical instrument (instrument main body) and a portion of the keyboard lid near to its rear end portion are connected by a link member, such that the instrument main body and the link member are pivotable and such that the keyboard lid and the link member are pivotable. Further, there is provided a guide abutment member at a position which is distant, by a suitable distance, from a position of the keyboard lid at which the link member is pivotally supported. When the keyboard lid is opened and closed, the guide abutment member is moved while being kept in contact with first and second guide portions of a guide member fixedly provided in the instrument main body. The first and second guide portions are constituted by at least two mutually different curved surfaces. In the disclosed opening/closing mechanism, it is possible to minimize a clearance between the keyboard lid and a front end of a top plate of the instrument main body and to reduce a space for a pivotal movement which is necessary to accommodate a rear portion of the keyboard lid in the instrument main body.

Patent Literature 1: U.S. Pat. No. 5,175,386

Patent Literature 2: JP-H03-119891-U

SUMMARY OF THE INVENTION

The keyboard lid opening/closing mechanism disclosed in Patent Literature 1, however, requires a space for accommodating the rear end portion of the keyboard lid in the instrument main body, causing hindrance to downsizing of the instrument main body. Further, since the lid is configured to be accommodated in the instrument main body, the number of components of the connecting mechanism provided between the lid and the main body may undesirably increase and the structure may undesirably become complicated.

As another structure of the keyboard lid opening/closing mechanism, there is known one disclosed in Patent Literature 2 in which a rear end portion of a keyboard lid formed of a single plate is pivotally attached to an instrument main body. Since the pivotal keyboard lid is a component formed of the single plate, the keyboard lid can be produced at a relatively low cost. Further, since the keyboard lid stands on the instrument main body when opened, no space is necessary for accommodating the lid in the instrument main body, as required in Patent Literature 1.

In the keyboard lid opening/closing mechanism disclosed in Patent Literature 2, however, the keyboard lid formed of the single plate pivots about a rear end portion of the keyboard lid, so that the position of a distal end of the lid largely changes in the vertical direction. Accordingly, a displacement amount of the position of the center of gravity is large when the lid is opened and closed, so that a change in the gravity is large at a portion of the distal end of the lid at which a user holds the lid. Further, the posture of the lid suddenly or abruptly changes, thereby causing a risk that the user's fingers may get caught between the rear end portion of the lid and the instrument main body.

The present invention provides a lid opening/closing mechanism for a keyboard musical instrument which ensures an easy opening/closing operation of a lid with a simplified and compact structure and which ensures good appearance of the keyboard musical instrument when the lid is opened.

More specifically, the present invention provides a lid opening/closing mechanism for a keyboard musical instrument, comprising:

a main body including a casing and a keyboard disposed in the casing and having a plurality of keys;

a plate-like lid attached to the casing so as to be movable between a closed position at which the lid is closed so as to cover the keyboard and an open position at which the lid is opened so as to uncover the keyboard; and a connecting mechanism for connecting a side wall portion disposed on one side of the keyboard in the casing and an end portion of the lid which is located at an end of the lid in a key arrangement direction in which the plurality of keys are arranged, the end portion being opposed to the side wall portion, wherein the connecting mechanism is configured such that, during a movement of the lid from the closed position to the open position, a rear end portion of the lid slidingly moves only in a direction from a rear end portion of the main body toward a front end portion thereof or moves in the direction from the rear end portion of the main body toward the front end portion thereof and in an upward direction.

BRIEF DESCRIPTION OF THE DRAWINGS

The above and other objects, features, advantages and technical and industrial significance of the invention will be better understood by reading the following detailed description of embodiments of the invention, when considered in connection with the accompanying drawings, in which:

FIG. 2 is a view showing a detailed structure of the lid opening/closing mechanism according to the first embodiment, more specifically, each of FIGS. 2A and 2B is a side cross-sectional view of the keyboard musical instrument while

FIG. 5 is a view showing a detailed structure of the lid opening/closing mechanism according to the second embodiment, more specifically.

DETAILED DESCRIPTION OF THE EMBODIMENTS

Hereinafter, there will be explained embodiments of the invention with reference to the drawings.

<First Embodiment>

Figure 1:
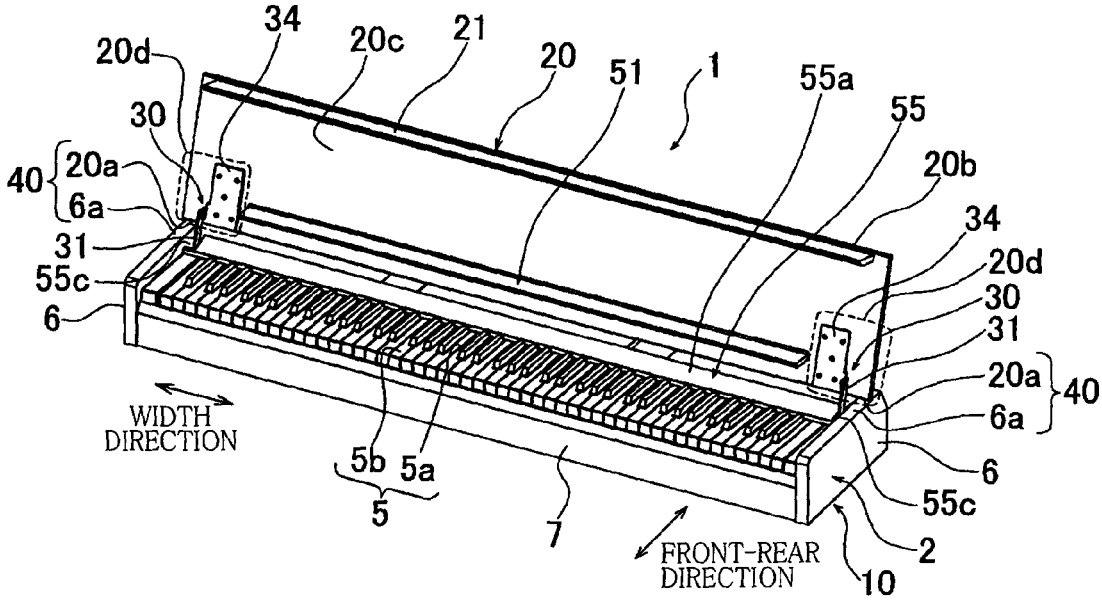
FIG. 1 is a perspective view showing one example of an overall structure of a keyboard musical instrument equipped with a lid opening/closing mechanism according to a first embodiment of the present invention.
Figure 2A:
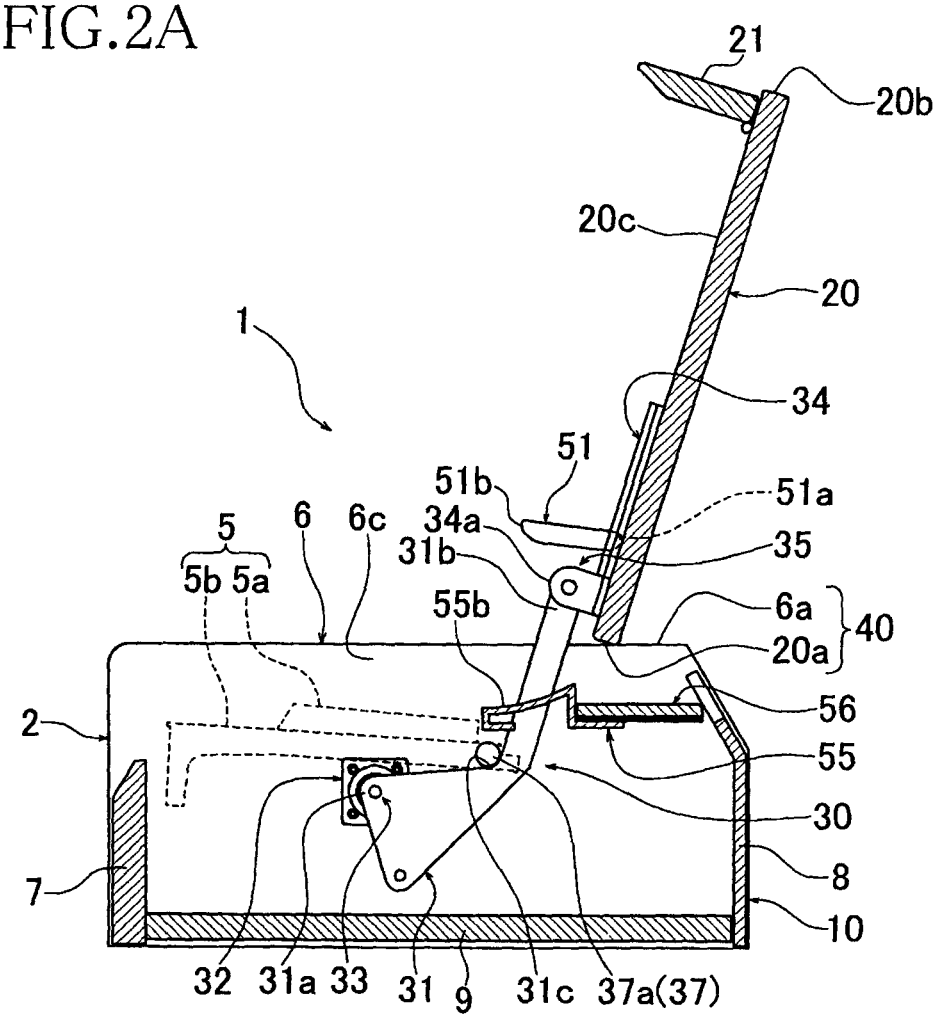
Figure 2B:
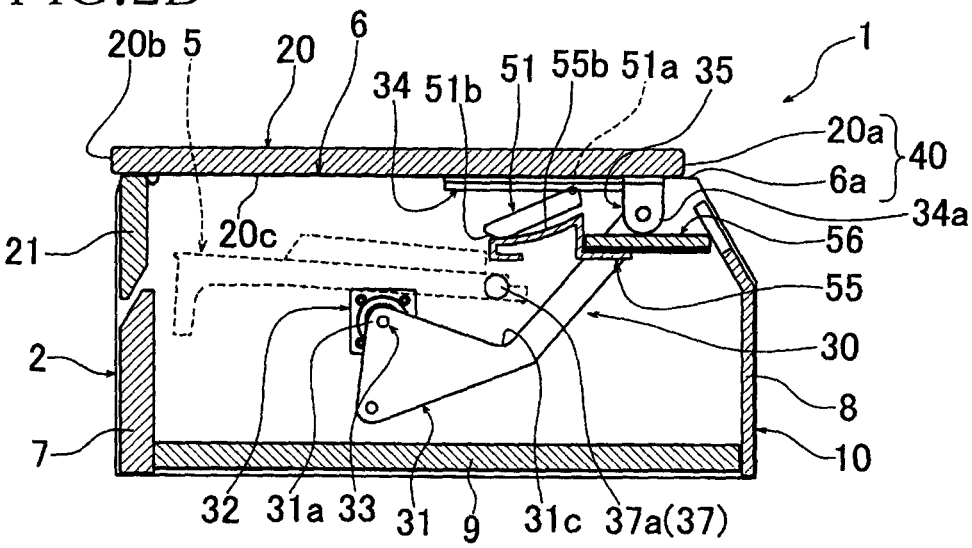
Figure 2C:
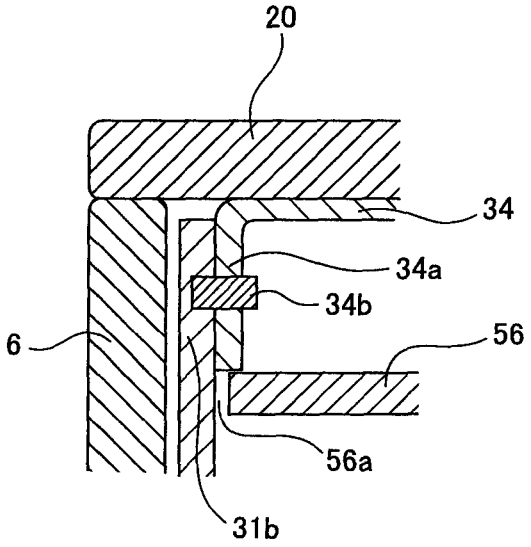
FIG. 2C is a cross-sectional view of a principal part of the keyboard musical instrument when viewed from a front side.

Each of FIGS. 1 and 2 is a perspective view showing one example of an overall structure of a keyboard musical instrument 1 equipped with a lid opening/closing mechanism according to a first embodiment of the present invention. FIG. 2 is a view showing a detailed structure of the lid opening/closing mechanism according to the first embodiment and is a side cross-sectional view of the keyboard musical instrument 1. In this respect, FIG. 2A shows a state in which a lid 20 (which will be explained) is at an open position while FIG. 2B shows a state in which the lid 20 is at a closed position. FIG. 2C is an enlarged view of a principal part of the keyboard musical instrument 1 for explaining a positional relationship between an end portion 31*b* of a connecting member 31 and other members, in the state in which the lid 20 is at the closed position, the view being in cross section seen from a front side.

The keyboard musical instrument 1 of the present embodiment comprises: a main body 2 including a casing 10 and a keyboard 5 disposed in the casing 10; and a lid (keyboard lid or fall board) 20 attached to the casing 10 of the main body 2. In the following description, "lateral direction" or "width direction" refers to a left-right direction in which keys 5*a*, 5*b* of the keyboard 5 are arranged. Further, "front" or "rear" refers to a front side of the keyboard 5 (i.e., a performer's side) or a rear side opposite to the performer's side. Moreover, "up" or "down" is used with respect to a vertical direction.

The keyboard 5 includes a plurality of black keys 5*a* and white keys 5*b* arranged in the lateral direction. Hereinafter, the direction in which the keys 5*a*, 5*b* are arranged will be also referred to as "key arrangement direction" where appropriate. The casing 10 that accommodates the keyboard 5 is composed of a pair of side plates (side wall portions) 6, 6 covering left and right end portions of the keyboard 5, a front plate 7 covering a front portion of the keyboard 5, a rear plate 8 covering a rear portion of the keyboard 5, and a bottom plate 9 covering a bottom portion of the keyboard 5. The casing 10 has a generally rectangular parallelepiped shape that is long in the lateral direction. The casing 10 has, at its upper portion, an opening through which an upper surface (performance-side surface) of the keyboard 5 is exposed. The lid 20 is attached to the casing 10 so as to be movable between a closed position at which the opening is entirely closed and an open position at which the opening is entirely open. The lid 20 is formed of a single plate member configured to close the opening when the lid 20 is placed on upper end faces 6*a*, 6*a* of the respective side plates 6, 6. The lid has a rectangular contour that is long in the lateral direction, following the contour of the casing 10. A lid front (lid front plate) 21 for covering a front surface of the keyboard 5 above the front plate 7 is attached to the vicinity of a front end of an inner surface (lower surface) 20*c* of the lid 20. In this embodiment, each of the side plates 6, 6 has a rectangular shape in side view, and the upper end faces 6*a*, 6*a* of the respective side plates 6*a*, 6*a* are substantially horizontal in a direction from a rear end portion of the main body 2 toward a front end portion thereof, namely, substantially parallel to the performance-side surface of the keyboard 5 and a longitudinal direction of the keys 5*a*, 5*b*. While a detailed illustration is omitted, each of the side plates 6, 6 may have a generally trapezoidal shape in side view, and the upper end faces 6*a*, 6*a* of the respective side plates 6, 6 may be formed as an inclined flat face that is inclined downwardly in the direction from the rear end portion of the main body 2 toward its front end portion.

There are further provided connecting mechanisms 30, 30 for movably connecting the lid 20 with respect to the main body 2. Each connecting mechanism 30 is disposed between a corresponding one of the side plates 6, 6 covering the left and right end portions of the keyboard 5 and a corresponding one of left and right end portions 20*d*, 20*d* of the lid 20 which are opposed to the respective side plates 6, 6. In the keyboard musical instrument 1 of the present embodiment, the connecting mechanisms 30, 30 have respective connecting members 31, 31 as a pair. Each connecting member 31 is disposed between a corresponding one of the side plates 6, 6 and a corresponding one of the opposite end portions of 20*d*, 20*d* of the lid 20 in the key arrangement direction. The pair of connecting members 31, 31 have left-right symmetrical configurations and attachment structures relative to each other. Accordingly, the following explanation will be made with respect to one connecting member 31. Here, the end portions

20*d*, 20*d* of the lid 20 refer to portions of the lid 20 including its widthwise opposite end faces and the inner surface 20*c* and an outer surface of the lid 20 in the vicinity of the widthwise opposite end faces (i.e., portions enclosed by the dot line in the drawings and vicinities thereof). In this respect, the inner surface 20*c* of the lid 20 is a surface of the lid 20 that faces an inside of the main body 2 and is opposed to the keyboard 5 when the lid 20 is located at the closed position. Further, the inner surface 20*c* of the lid 20 is a surface of the lid 20 that faces downward when the lid 20 is located at the closed position.

As shown in FIG. 2, each connecting member 31 is formed of a long plate, and one of its longitudinally opposite end portions (i.e., one end portion 31*a*) is pivotally supported by a first pivotally-support portion 33 provided at an inner side surface 6*c* of a corresponding one of the side plates 6 while the other of its longitudinally opposite end portions (i.e., the other end portion 31*b*) is pivotally supported by a second pivotally-support portion 35 provided on the inner surface 20*c* of the lid 20 facing toward the keyboard 5, at a corresponding one of the end portions 20*d* of the lid 20. The first pivotally-support portion 33 pivotally or rotatingly supports (namely, supports by linkage) the one end portion 31*a* of the connecting member 31 relative to the inner side surface 6*c* of the corresponding side plate 6, about a rotation axis whose axial direction coincides with the width direction of the main body 2. The second pivotally-support portion 35 pivotally or rotatingly supports (namely, supports by linkage) the other end portion 31*a* of the connecting member 31 relative to the inner surface 20*c* of the lid 20, about a rotation axis whose axis direction coincides with the width direction of the lid 20. More specifically, the first pivotally-support portion 33 pivotally supports the one end portion 31*a* of the connecting member 31 by a torque-generating type bearing 32 fixed to the inner side surface 6*c* of the corresponding side plate 6. The torque-generating type bearing 32 will be later explained. The second pivotally-support portion 35 pivotally supports, through a shaft portion 34*b*, the other end portion 31*b* of the connecting member 31 by a support piece 34*a* provided on an attachment plate 34 which is fixed by screwing to the inner surface 20*c* of the lid 20.

The connecting member 31 has a thin plate whose longitudinal direction extends from the first pivotally-support portion 33 to the second pivotally-support portion 35, and has, at its intermediate portion between the first pivotally-support portion 33 and the second pivotally-support portion 35, a bent portion 31*c* which is bent into a dog-legged or a V-like shape in one plane. The connecting member 31 is attached such that its surface is parallel to the inner side surface 6*c* of the side plate 6 and such that an inner side of the bent portion 31*c* is directed upward. The first pivotally-support portion 33 is located at a position which is lower and more frontward than the second pivotally-support portion 35 when the lid 20 is located at the open position and when the lid 20 is located at the closed position. In other words, the first pivotally-support portion 33 is located more frontward than the second pivotally-support portion 35 in a front-rear direction of the main body 2 and is located more downward than the second pivotally-support portion 35 in the vertical direction, when the lid 20 is located at the open position and when the lid 20 is located at the closed position.

While a detailed illustration and explanation of the structure of the torque-generating type bearing 32 provided at the first pivotally-support portion 33 are omitted, there may be employed, as the torque-generating type bearing 32, a rotary damper mechanism (oil damper mechanism) which has a cylindrical housing filled with a working oil and a rotary member rotatingly fitted in the housing and which is configured such that a damping force acts with respect to rotation of the rotary member by a sliding resistance owing to a hydraulic pressure of the working oil. As the torque-generating type bearing 32 constituted by such a rotary damper mechanism, there may be used bearings disclosed in JP-A-2001-349364 and JP-A-2008-185215, for instance. It is noted that the above-described torque-generating type bearing 32 is a component functioning as a resistance-force generating portion configured to generate a resistance force against relative rotation of the main body 2 and the connecting member 31 and relative rotation of the lid 20 and the connecting member 31.

In place of the oil damper mechanism, the bearing 32 may be a rotary damper mechanism (rotational friction mechanism) configured to generate a frictional force by sliding of a plurality of resin components disposed around a rotation axis. As this rotational friction mechanism, there may be employed a damper mechanism which is configured to generate a large magnitude of frictional force only in rotation in one direction and which is configured to generate a larger magnitude of frictional force with an increase in a rotational speed. (This damper mechanism is referred to as "one-way clutch mechanism".) In an arrangement in which such a damper mechanism is used, where the damper mechanism is disposed so as to generate a large frictional force in a direction in which the lid 20 is moved from the open position toward the closed position, the movement of the lid 20 toward the closed position becomes slow. Accordingly, it is possible to reduce a risk that fingers of the user or the like get caught between the lid 20 and the upper end face 6*a* of the side plate 6, when the lid 20 is closed.

The lid opening/closing mechanism of the present embodiment has a slide mechanism 40 configured such that, during a movement of the lid 20 between the closed position and the open position, a rear end portion 20*a* of the lid 20 slidingly moves on the upper end faces 6*a* of the side plates 6, namely, on the upper surface of the main body 2. The slide mechanism 40 is constituted by the upper end faces 6*a* of the side plates 6 and the rear end portion 20*a* of the lid 20. In the slide mechanism 40, the rear end portion 20*a* of the lid 20 that is separably in contact with the upper end faces 6*a* of the side plates 6 slides on the upper end faces 6*a* of the side plate 6 in the front-rear direction. Here, the upper end faces 6*a* of the side plates 6 extend is in the front-rear direction of the main body 2 so as to be substantially parallel to the longitudinal direction of the black keys 5*a* and the white keys 5*b* and to the performance-side surface (the upper surface) of the keyboard 5. Accordingly, during the movement of the lid 20 from the closed position to the open position, the rear end portion 20*a* of the lid 20 is moved by the slide mechanism 40 in a direction from the rear end portion of the main body 2 toward the front end portion thereof in the longitudinal direction of the keys 5*a*, 5*b*, namely, the rear end portion 20*a* of the lid 20 is moved by the slide mechanism 40 so as to be parallel to the performance-side surface of the keyboard 5. The performance-side surface of the keyboard 5 used herein refers to a substantially horizontal surface including upper-surface portions of the keys 5*a*, 5*b* touched by the fingers of the performer. Depending upon the type or form of the keyboard 5, the upper-surface portions of the keys 5*a*, 5*b* are slightly inclined in the front-rear direction of the main body 2. In such a case, the performance-side surface of the keyboard 5 also refers to the substantially horizontal surface including the upper-surface portions of the keys 5*a*, 5*b*. As shown in FIG. 2B, the rear end portion 20*a* of the lid 20 is a rear end of the lid 20 when the lid 20 is located at the closed position while the front end portion 20*b* of the lid 20 is a front end of the lid 20 when the lid 20 is located at the closed position. Further, the rear end portion 20*a* of the lid 20 may be referred to as a portion (slidingly-contact portion) of the lid 20 that is in sliding contact with the upper end faces 6*a* of the side plates 6*a* during the movement of the lid 20 between the closed position and the open position.

The lid opening/closing structure of the present embodiment further includes stopper portions 37 each for stopping a movement of the connecting member 31 in the state in which the lid 20 is located at the open position. The stopper portion 37 has a rod-like engagement member (pin) 37*a* provided so as to extend from the inner side surface 6*c* of the side plate 6. The engagement member 37*a* protrudes from the inner side surface 6*c* of the side plate 6 such that its axial direction extends in the lateral direction (in the horizontal direction). When the engagement member 37*a* comes into abutting contact with the bent portion 31*c* of the connecting member 31 at the open position of the lid 20 at which the lid 20 is fully opened, the rotation or pivotal movement of the connecting member 31 about the first pivotally-support portion 33 is limited at the position where the engagement member 37*a* comes into abutting contact with the bent portion 31*c* of the connecting member 31.

A music stand 51 is attached to the inner surface 20*c* of the lid 20. The music stand 51 is a thin plate and is attached to a widthwise central portion of the inner surface 20*c* near to the rear end portion 20*a* of the lid 20. The music stand 51 is pivotally or rotatably supported, at an end face thereof nearer to the lid 20, by a shaft portion 51*a*, with respect to the inner surface 20*c* of the lid 20. The shaft portion 51*a* supports the music stand 51 such that the music stand 51 is pivotable or rotatable about an axis extending in the lateral direction (the width direction) of the main body 2. According to the arrangement, the music stand 51 is rotatable about the shaft portion 51*a* between: a closed position at which the music stand 51 is folded such that its surface extends along the inner surface 20*c* of the lid 20; and an open position at which the music stand 51 is open such that its surface extends substantially perpendicularly to the inner surface 20*c* of the lid 20.

A plate-like panel member 55 is disposed at a rear portion of the keyboard 5 in the casing 10 of the main body 2, namely, on a rear side of depressible portions of the black keys 5*a* and the white key 5*b*. Further, a concealment plate 56 is attached between a rear end of the panel member 55 and an upper end of the rear plate 8 of the casing 10 for closing a clearance therebetween. The panel member 55 has a panel surface 55*b* covering the upper surface of the keyboard 5 at the rear portion of the keyboard 5. The panel surface 55*b* is an inclined curved surface that is inclined in the front-rear direction of the main body 2 while slightly curved. The panel surface 55*b* is located at a position corresponding to the position of the music stand 51 attached to the inner surface 20*c* of the lid 20. As will be explained later, when the lid 20 is moved to the closed position at which the keyboard 5 is covered, a distal end portion 51*b* of the music stand 51 comes into contact with the panel surface 55*b*, whereby the music stand 51 is automatically folded. The first pivotally-support portion 33 by which the one end portion 31*a* of the connecting member 31 in its longitudinal direction is pivotally supported and which is provided on the inner side surface 6*c* of the corresponding side plate 6 is disposed at a height position, in the up-down direction, lower than the concealment plate 56. That is, the concealment plate 56 is disposed at a height position, in the up-down direction, higher than the first pivotally-support portion 33. The second pivotally-support portion 35 (as one example of a joint) which pivotally supports the other end portion 31*b* of the connecting member 31 in its longitudinal direction and which is provided on the inner surface 20*c* of the lid 20 facing toward the keyboard 5 is disposed at a height position, in the up-down direction, higher than the concealment plate 56 and lower than the lid 20, when the lid 20 is located at the closed position, as shown in FIG. 2B. In other words, when the lid 20 is located at the closed position, namely, when the inner surface 20*c* of the lid 20 is facing downward, the second pivotally-support portion 35 is located at a height position, in the up-down direction, lower than the lid 20 and higher than the concealment plate 56. Further, when the lid 20 is located at the closed position, the second pivotally-support portion 35 is disposed in a space between the concealment plate 56 and a part of the lid 20 near to the rear end portion 20*a* of the lid 20, in the up-down direction.

Figure 5A:
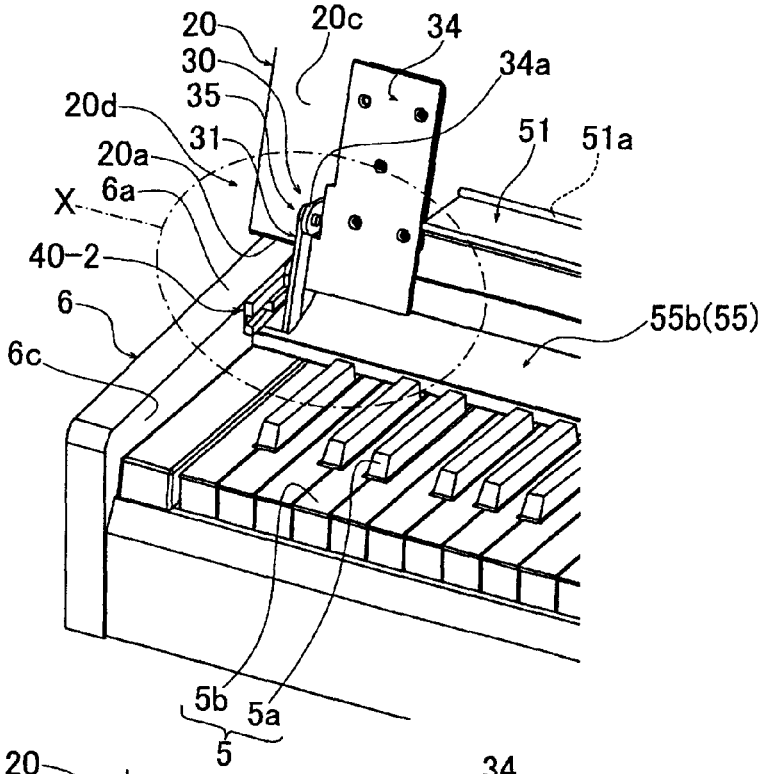
FIG. 5A is a partially enlarged perspective view showing one side portion of a main body and FIG. 5B is a partially enlarged view showing a part X in FIG. 5A.
Figure 5B:
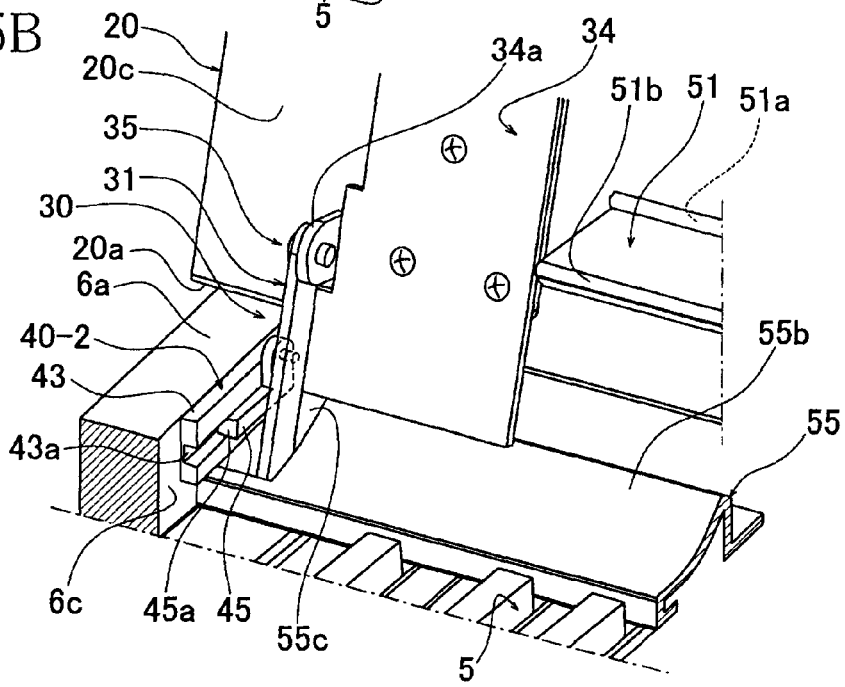

As shown in FIG. 1, widthwise opposite end portions of the panel member 55 are fixed to the respective inner side surfaces 6*c*, 6*c* of the side plates 6, 6. As shown in FIG. 5B, cutouts 55*c* are respectively formed in the widthwise opposite end portions of the panel member 55. In FIG. 5B, the cutout 55*c* formed in one of the widthwise opposite end portions of the panel member 55 is shown. The cutout 55*c* cooperates with the inner side surface 6*c* of the side plate 6 to form an opening for permitting the connecting member 31 to pass therethrough. In this arrangement, when the lid 20 is located at the open position as shown in FIG. 2A, the connecting member 31 upwardly protrudes from the lower side of the panel member 55 through the cutout 55*c*, and the upper end portion, i.e., the other end portion 31*b*, of the connecting member 31 is connected to the inner surface 20*c* of the lid 20. When the lid 20 is located at the closed position as shown in FIG. 2C, there is formed a clearance 56*a* between the concealment plate 56 and the inner side surface 6*c* of the side plate 6, for permitting the connecting member 31 to upwardly protrude from the lower side of the concealment plate 56, and the other end portion 31*b* of the connecting member 31 is located between the concealment plate 56 and the lid 20 in the up-down direction. During the movement of the lid 20 from the open position to the closed position, the other end portion 31*b* (the second pivotally-support portion 35) does not move below the concealment plate 56, whereby it is possible to reduce a dimension (width) of the clearance 56*a* formed between the concealment plate 56 and the inner side surface 6*c* and it is possible to reduce a dimension (width) of a clearance between the connecting member 31 and the concealment plate 56. Therefore, foreign substances are prevented from entering the inside of the casing 10 from the outside of the casing 10. While not shown, there may be provided at least one of a member extending from the inner side surface 6*c* to the connecting member 31 for closing a clearance therebetween; and; a member extending from the concealment plate 56 to the connecting member 31 for closing a clearance therebetween, thereby more effectively preventing entry of the foreign substances into the casing 10.

Figure 3A:
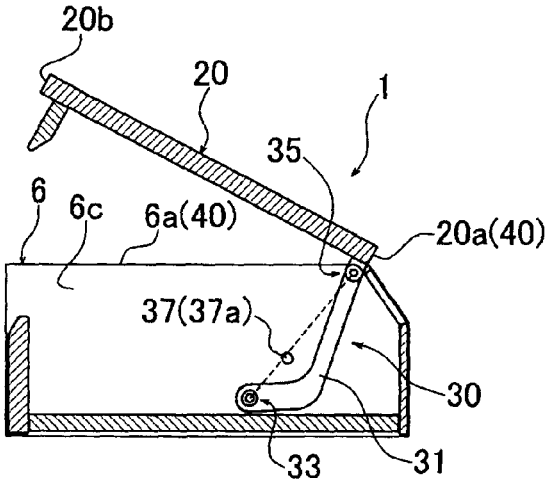
FIG. 3 is a view for explaining a motion of the lid when the lid moves between a closed position and an open position.
Figure 3B:
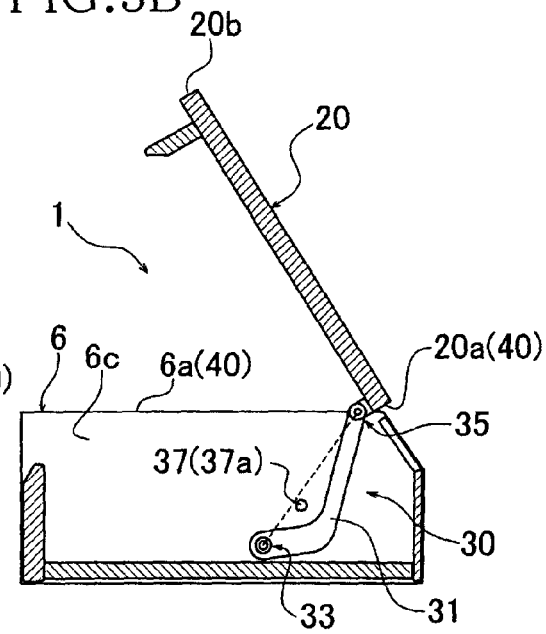
Figure 3C:
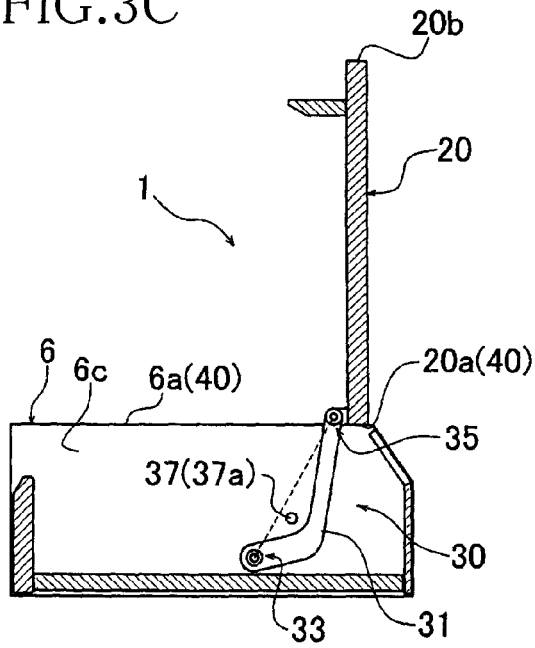
Figure 3D:
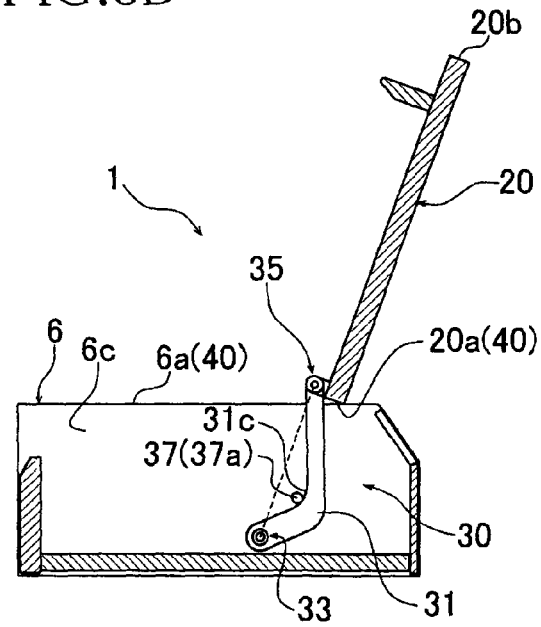

FIGS. 3A-3D are views for explaining a motion of the lid 20 when the lid 20 moves between the closed position and the open position. In FIGS. 3A-3D, only principal components relating to the opening/closing operation of the lid 20 such as the connecting member 31 and the stopper portion 37 are illustrated. With reference to FIGS. 3A-3D, in addition to FIG. 2, the opening/closing operation of the lid 20 according to the lid opening/closing mechanism constructed as described above will be explained. Initially, in a state shown in FIG. 2B, the lid 20 is located at the closed position at which the lid 20 is closed so as to completely cover the keyboard 5, in other words, at which a space in the casing 10 above the keyboard 5 is completely closed. In this state, portions of the inner surface 20*c* of the lid 20 corresponding to the end portions 20*d*, 20*d* are placed on the upper end faces 6*a*, 6*a* of the side plates 6, 6. When the front end portion 20*b* of the lid 2 is lifted upward from this state, the lid 20 pivots sequentially in order as shown in FIGS. 3A, 3B, and 3C, so that the space in the casing 10 above the keyboard 5 is gradually opened, namely, the keyboard 5 is gradually uncovered. On this occasion, the second pivotally-support portion 35 of the connecting member 31 pivots frontward about the first pivotally-support portion 33 as a pivot point while the rear end portion 20*a* of the lid 20 slidingly moves in the direction from the rear end portion of the main body 2 toward the front end portion thereof along the upper end faces 6*a* of the side plates 6. As a result, the front end portion 20*b* of the lid 20 pivots upward about the second pivotally-support portion 35 as a pivot point. Finally, the connecting member 31 and the lid 20 stop moving at the position where the connecting member 31 comes into abutting contact with the engagement member 37*a* of the stopper portion 37, as shown in FIGS. 3D and FIG. 2A. At this position, the lid 20 is located at the open position at which the lid 20 is fully opened. At the open position, the lid 20 disposed on the upper surface of the main body 2 is in a posture in which the rear end portion 20*a* of the lid 20 is located slightly frontward as compared with the front end portion 20*b* of the lid 20, such that the inner surface 20*c* of the lid 2 is slightly inclined rearward. The position of the lid shown in FIGS. 2A and 3D is the open position at which the lid 20 is completely opened with respect to the main body 2, in other words, the position at which the lid 20 is opened to a maximum extent with respect to the main body 2 (i.e., the position at which a degree of opening of the lid 20 with respect to the main body 2 is the largest). In this instance, the position at which the lid 20 is opened to a maximum extent with respect to the main body 2 is defined by: the engagement members 37*a* of the stopper portions 37 each of which comes into abutting contact with the connecting member 31; and the rear end portion 20*a* of the lid 20 that is in sliding contact with the upper end faces 6*a* of the side plates 6, as shown in FIGS. 2A and 3D.

On the other hand, when the front end portion 20*b* of the lid 20 located at the open position shown in FIGS. 2A and 3D is pulled forward, the lid 20 moves toward the closed position. In this instance, contrary to the above-indicated movement of the lid 20 toward the open position, the lid 20 pivots sequentially in order as shown in FIGS. 3C, 3B, and 3A, so that the space in the casing 10 above the keyboard 5 is gradually closed, namely, the keyboard 5 is gradually covered. On this occasion, the second pivotally-support portion 35 of the connecting member 31 pivots rearward about the first pivotally-support portion 33 as a pivot point while the rear end portion 20*a* of the lid 20 slidingly moves along the upper end faces 6*a* of the side plates 6 from the front end portion of the main body 2 toward the rear end portion thereof. As a result, the front end portion 20*b* of the lid 20 pivots downwards about the second pivotally-support portion 35 as a pivot point. Finally, as shown in FIG. 2B, the lid 20 is located at the closed position at which the lid 20 is fully closed so as to cover the keyboard 5, with the portions of the inner surface 20*c* of the lid 20 corresponding to the end portions 20*d*, 20*d* of the lid 20 placed or rested on the upper end faces 6*a*, 6*a* of the side plates 6.

In a period in which the lid 20 moves from the state shown in FIG. 3A to the state shown in FIG. 2B, a load that acts on each connecting mechanism 30 due to a self-weight of the lid 20 becomes large. In view of this, it is preferable that the frictional force generated by each bearing 32 in the range described above be set at a large value. As the thus set bearing 32, the above-described rotational friction mechanism configured to generate the frictional force by sliding of the plurality of resin components or the above-described one-way clutch mechanism may be used.

The lid opening/closing mechanism constructed as described above according to the present embodiment ensures an easy opening/closing operation of the lid 20 and improves an appearance of the keyboard musical instrument 1 when the lid 20 is opened/closed.

The lid opening/closing mechanism according to the present embodiment has: the connecting members 31 each of which is formed of the long plate and each of which has one end portion 31*a* pivotally supported by the first pivotally-support portion 33 provided at the side plate 6 and the other end portion 31*b* pivotally supported by the second pivotally-support portion 35 provided at the inner surface 20*c* of the lid 20; and the slide mechanism 40 configured such that, during the movement of the lid 20 between the closed position and the open position, the rear end portion 20*a* of the lid 20 slidingly moves in the front-rear direction of the main body 2. During the movement of the lid 20 from the closed position to the open position, the rear end portion 20*a* of the lid 20 slidingly moves in the direction from the rear end portion of the main body 2 toward the front end portion thereof in the longitudinal direction of the keys 5*a*, 5*b*. According to the arrangement, the structure of the connecting mechanism 30 that connects the main body 2 of the keyboard musical instrument 1 and the lid 20 can be simplified with a reduced number of components, and at the same time, it is possible to suppress displacement of the position of the center of gravity of the lid 20 when the lid 20 is opened and closed. Therefore, it is possible to prevent the posture of the lid 20 from abruptly changing when the lid 20 is opened/closed, simplifying the opening/closing operation of the lid 20.

In the connecting mechanism 30 of the present embodiment, the first pivotally-support portion 33 is disposed at a position nearer to the front end portion of the main body 2 than the second pivotally-support portion 35. The arrangement makes the connecting mechanism 30 compact, and at the same time, ensures a smooth movement of the lid 20 between the closed position and the open position.

In the lid opening/closing mechanism according to the present embodiment, the pair of side plates 6, 6 disposed on opposite sides of the keyboard 5 in the casing 10 are provided. Further, the connecting mechanisms 30, 30 include the pair of connecting members 31, 31 each of which connects a corresponding one of the side plates 6, 6 and a corresponding one of the end portions 20*d*, 20*d* of the lid 20. Moreover, the slide mechanism 40 is configured such that the rear end portion 20*a* of the lid 20 that is separably in contact with the upper end faces 6*a*, 6*a* of the side plates 6, 6 slides on the upper end faces 6*a*, 6*a* of the side plates 6, 6.

As described above, since the slide mechanism 40 is constituted by the upper end faces 6*a* of the side plates 6 and the rear end portion 20*a* of the lid 20, the slide mechanism 40 does not need dedicated components while ensuring the smooth opening/closing operation of the lid 20. Therefore, the number of components of the connecting mechanism 30 can be reduced, resulting in a simplified structure and a reduced cost of the keyboard musical instrument 1.

The lid opening/closing mechanism according to the present embodiment includes the stopper portions 37 (the engagement members 37*a*) each configured to stop the movement of the lid 20 by coming into contact with the corresponding connecting member 31, in the state in which the lid 20 is located at the open position. Further, the lid 20 located at the open position is disposed on the upper surface of the main body 2 in an inclined state in which the rear end portion 20*a* of the lid 20 is located nearer to the front end portion of the main body 2 than the front end portion 20*b* of the lid 20.

As described above, the engagement members 37*a* of the stopper portions 37 come into contact with the respective connecting members 31 so as stop the movement of the lid 20, in the state in which the lid 20 is located at the open position, whereby the lid 20 can be stopped at the open position with high reliability and the opening/closing operation of the lid 20 is stabilized. Further, it is possible to prevent the rear end portion 20*a* of the lid 20 and the upper end faces 6*a* of the side plates 6 from moving or separating away from each other at the open position of the lid 20. Therefore, the lid 20 is prevented from falling backward at the open position. Further, it is possible to prevent the user's fingers or the like from getting caught between the rear end portion 20*a* of the lid 20 and the upper end faces 6*a* of the side plates 6.

When the lid 20 is located at the open position, the lid 20 is disposed on the upper surface of the main body 2 in the inclined state in which the rear end portion 20*a* of the lid 20 is located nearer to the front end portion of the main body 2 than the front end portion 20*b* of the lid 20, so that the lid 20 can be kept located at the open position with high stability. Accordingly, the lid 20 located at the open position can be prevented, with high reliability, from being unexpectedly moved toward the closed position and accordingly closed.

<Second Embodiment>

There will be next explained a second embodiment of the present invention. In the following explanation and drawings of the second embodiment, the same reference numerals as used in the first embodiment are used to identify the corresponding components, and detailed explanation is dispensed with. Details other than those explained below are the same as in the first embodiment. This is true for other embodiments.

Figure 4:
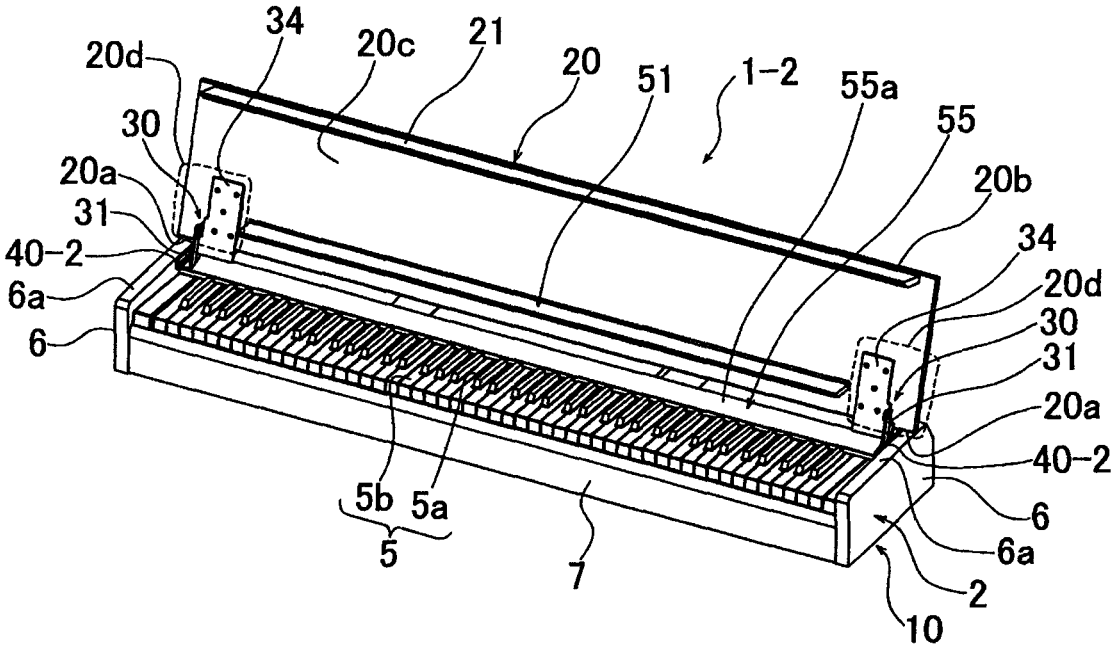
FIG. 4 is a perspective view showing one example of an overall structure of a keyboard musical instrument equipped with a lid opening/closing mechanism according to a second embodiment of the present invention.

FIG. 4 is a perspective view showing one example of an overall structure of a keyboard musical instrument 1-2 equipped with a lid opening/closing mechanism according to the second embodiment of the present invention. FIG. 5 is a view showing a detailed structure of the lid opening/closing mechanism according to the second embodiment, more specifically, FIG. 5A is a partially enlarged perspective view showing one side portion of the main body 2 and FIG. 5B is a partially enlarged view showing a part X in FIG. 5A.

In the lid opening/closing mechanism according to the second embodiment, the slide mechanism 40 of the lid opening/closing mechanism of the first embodiment configured such that the rear end portion 20*a* of the lid 20 slides on the upper end faces 6*a* of the side plates 6 is replaced with two slide mechanisms 40-2 shown in FIG. 5B. More specifically, each slide mechanism 40-2 includes: a guide member 43 having a linear guide groove (concave portion) 43*a* provided on the side of the side plate 6; and a slide member 45 having a slide protrusion (convex portion) 45*a* provided on the side of the lid 20, and the slide protrusion 45*a* is slidably fitted in the guide groove 43*a*.

Each of the guide member 43 and the slide member 45 of the slide mechanism 40-2 is a product having a smooth surface and formed of synthetic resin. The guide member 43 is a generally rectangular member attached to the inner side surface 6*c* of the side plate 6. The guide groove 43*a* is a groove having a generally U-shaped cross section, and its longitudinal direction extends substantially horizontally in the front-rear direction of the main body 2 along the longitudinal direction of the keys 5*a*, 5*b*. The slide member 45 is pivotally attached to the attachment plate 34 fixed to the lid 20. The slide member 45 is configured to move in the front-rear direction of the main body 2 in association with the opening/closing operation of the lid 20. The slide protrusion 45*a* is a protrusion which has a generally U-shaped cross section and which is slidably fitted in the guide groove 43*a*. The guide groove 43*a* has a length dimension that permits the slide protrusion 45*a* to be fitted therein over an entire range of the movement of the lid 20 from the closed position to the open position.

Figure 6:
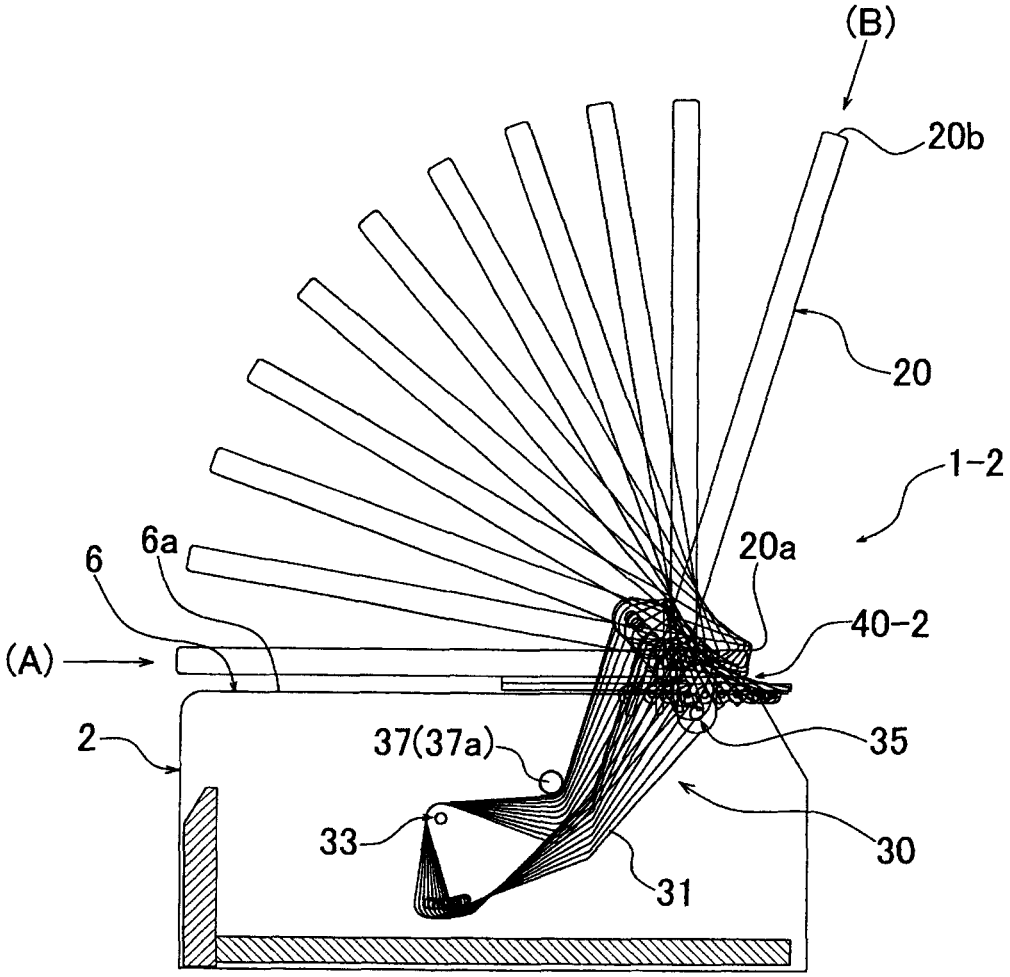
FIG. 6 is a view for explaining a motion of the lid when the lid moves from the closed position to the open position.

FIG. 6 is a view for explaining a motion of the lid 20 when the lid 20 moves from the closed position to the open position, in the lid opening/closing mechanism according to the present embodiment. In FIG. 6, a locus of the lid 20 formed when the lid 20 moves from the closed position to the open position is successively illustrated. Initially, when the front end portion 20*b* of the lid 20 located at the closed position (A) in FIG. 6 is lifted upward, the lid 20 pivots and the space above the keyboard 5 is gradually opened, namely, the keyboard 5 is gradually uncovered. On this occasion, the second pivotally-support portion 35 of the connecting member 31 pivots frontward and upward about the first pivotally-support portion 33 as a pivot point. At the same time, the slide protrusion 45*a* of each slide mechanism 40-2 shown in FIG. 5B horizontally slidingly moves in the direction from the rear end portion of the main body 2 toward the front end portion of thereof along the guide groove 43*a*, while being prevented from moving in the up-down direction by the guide groove 43*a*. As a result, the rear end portion 20*a* of the lid 20 slidingly moves in the direction from the rear end portion of the main body 2 toward the front end portion thereof along the upper end faces 6*a* of the side plates 6. Accordingly, the front end portion 20*b* of the lid 20 pivots upward about the second pivotally-support portion 35 as a pivot point. Finally, the connecting member 31 and the lid 20 stop moving at the position where the connecting member 31 comes into abutting contact with the engagement member 37*a* of the stopper portion 37. At this position, the lid 20 is located at the open position (B) at which the lid 20 is fully opened. As in the first embodiment, at the open position (B), the lid 20 is in the posture in which the rear end portion 20*a* of the lid 20 is located slightly frontward as compared with the front end portion 20*b* of the lid 20, such that the inner surface 20*c* of the lid 20 is slightly inclined rearward.

On the other hand, when the front end portion 20*b* of the lid 20 located at the open position (B) in FIG. 6 is pulled forward, the lid 20 moves toward the closed position (A), and the space in the casing 10 above the keyboard 5 is gradually closed, namely, the keyboard 5 is gradually covered. On this occasion, the second pivotally-support portion 35 of the connecting member 31 pivots rearward and downward about the first pivotally-support portion 33 as a pivot point while the rear end portion 20*a* of the lid 20 slidingly moves in the direction from the front end portion of the main body 2 toward the rear end portion thereof along the upper end faces 6*a* of the side plates 6. As a result, the front end portion 20*b* of the lid 20 pivots downward about the second pivotally-support portion 35 as a pivot point. Finally, the lid 20 is located at the closed position (A) at which the lid 20 is fully closed so as to cover the keyboard 5, with the portions of the inner surface 20*c* of the lid 20 corresponding to the opposite end portions 20*d*, 20*d* of the lid 20 placed or rested on the upper end faces 6*a*, 6*a* of the side plates 6, 6.

As described above, the lid opening/closing mechanism according to the second embodiment includes the slide mechanisms 40-2 each of which has: the guide member 43 disposed on the side plate 6 and having the guide groove (concave portion) 43*a;* and the slide member 45 disposed on the lid 20 and having the slide protrusion (convex portion) 45*a*, as shown in FIG. 5. In the slide mechanism 40-2, the slide protrusion 45*a* is fitted in the guide groove 43*a*, such that the slide protrusion 45*a* slidingly moves while the slide protrusion 45*a* and the guide groove 43*a* are prevented from being separated or moved away from each other. The arrangement ensures a further smooth opening/closing operation of the lid 20. In addition, during the movement of the lid 20 between the closed position and the open position, a spacing between the upper end faces 6*a* of the side plates 6 and the rear end portion 20*a* of the lid 20 can be kept substantially constant, whereby it is possible to prevent the user's fingers or the like from getting caught therebetween. Moreover, each connecting member 31 that connects the lid 20 and the corresponding side plate 6 is prevented from suffering from twisting or distortion.

Figure 7A:
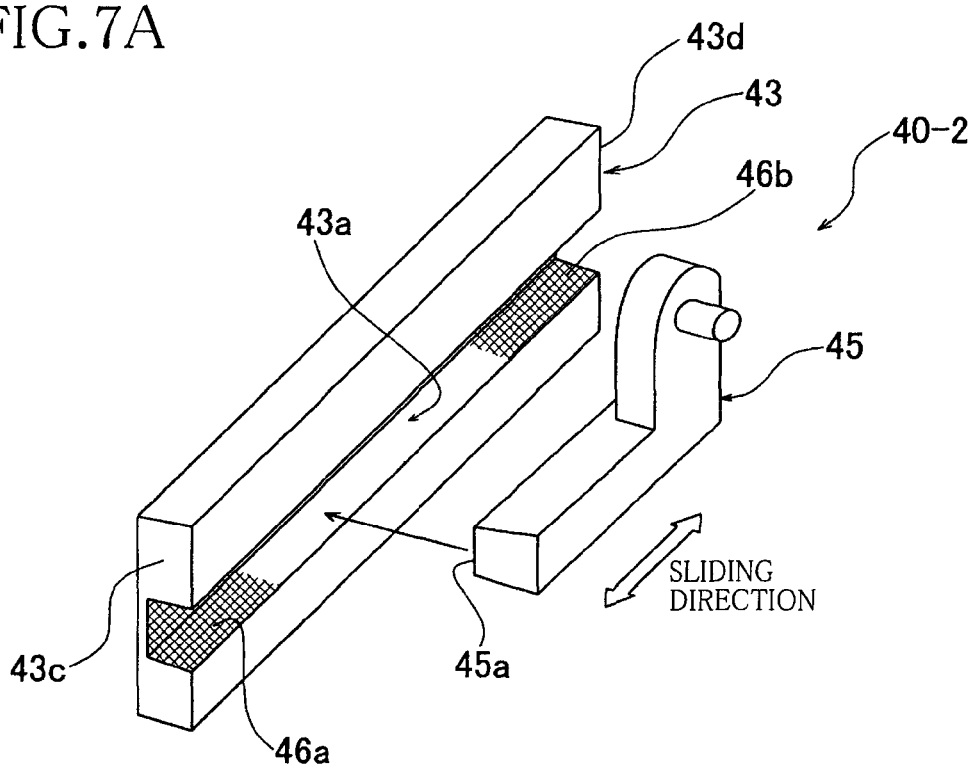
FIG. 7 is a view showing a structure of a friction portion provided in a slide mechanism.

FIG. 7 is a view showing one example of a resistance-force generating portion provided in the slide mechanism 40-2. The slide mechanism 40-2 of the present embodiment may have, as the resistance-force generating portion configured to generate a resistance force against the movement of the lid 20, frictional surfaces 46*a*, 46*b* formed in an inner surface of the guide groove 43*a* of the guide member 43, as shown in FIG. 7A. The frictional surfaces 46*a*, 46*b* are provided on the inner surface of the guide groove 43*a* at portions corresponding to opposite end portions, i.e, a front end portion 43*c* and a rear end portion 43*d*, of the guide member 43*a* in the front-rear direction and vicinities thereof. Each of the frictional surfaces 46*a*, 46*b* is formed by roughening the inner surface of the guide groove 43*a*. At the portions of the inner surface of the guide groove 43*a* at which the frictional surfaces 46*a*, 46*b* are provided, a sliding resistance of the slide protrusion 45*a* is made larger, as compared with other portions.

Figure 7B:
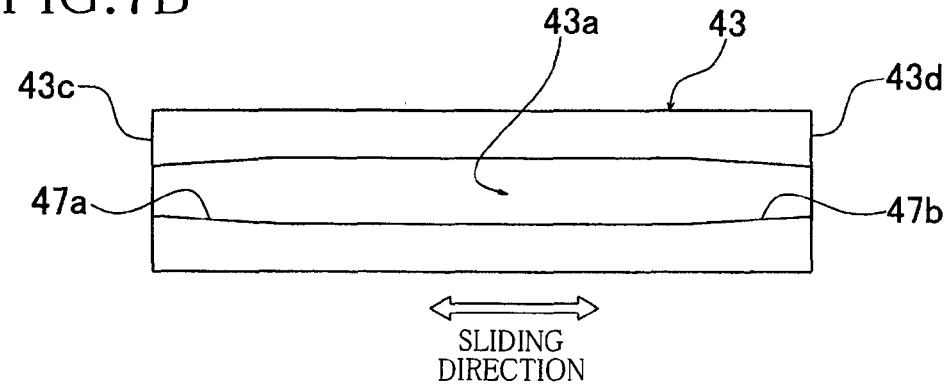

As another example of the resistance-force generating portion, there may be provided inclined surfaces 47*a*, 47*b* which are formed by slightly inclining the inner surface of the guide groove 43*a* with respect to a slide direction, as shown in FIG. 7B. The inclined surfaces 47*a*, 47*b* are obtained by gradually reducing a width dimension of the guide groove 43*a* as measured in the up-down direction, toward the opposite end portions (the front end portion 43*c* and the rear end portion 43*d*) of the guide member 43. At portions of the inner surface of the guide groove 43*a* at which the inclined surfaces 47*a*, 47*b* are provided, the width dimension of the guide groove 43*a* through which the slide protrusion 45*a* passes is made smaller than other portions, whereby the sliding resistance of the slide protrusion 45*a* is made larger.

Concerning the frictional surfaces 46*a*, 46*b* or the inclined surface 47*a*, 47*b* described above, there may be provided at least one of or both of the frictional surface 46*a* or the inclined surface 47*a* formed at the rear end portion 43*d* of the guide member 43 corresponding to the closed position of the lid 20 (i.e., the frictional surface 46*a* or the inclined surface 47*a* as a part of a region in which the slide member 45 is in contact with the guide member 43 when the lid 20 is located at the closed position); and the frictional surface 46*b* or the inclined surface 47*b* formed at the front end portion 43*c* of the guide member 43 corresponding to the open position of the lid 20 (i.e., the frictional surface 46*b* or the inclined surface 47*b* as a part of the region in which the slide member 45 is in contact with the guide member 43 when the lid 20 is located at the open position). In this instance, the frictional surface 46 or the inclined surface 47 is not formed at a portion of the guide groove 43*a* corresponding to an intermediate position between the closed position and the open position of the lid 20. That is, the frictional surface 46 or the inclined surface 47 is not formed in a region in which the slide member 45 is in contact with the guide member 43 when the lid 20 is located at the intermediate position. According to the arrangement, the resistance force against the movement of the lid 20 is generated only at the open position, the closed position, and vicinities thereof at which a large load acts on the user due to the weight of the lid 20 when the lid 20 is opened/closed.

According to the resistance-force generating portion of the slide mechanism 40-2 in the present embodiment constituted by the frictional surface 46 or the inclined surface 47, it is possible to generate the resistance force against the movement of the lid 20 at the open position, the closed position, and vicinities thereof at which a large load acts on the user when the lid 20 is opened/closed. Therefore, the load that acts on the user can be effectively reduced, whereby the opening/closing operation of the lid 20 can be smoothly carried out with a smaller force. Further, owing to the resistance force, the motion of the lid 20 when the lid 20 is opened/closed can be made slow, whereby the fingers of the user or the like are more effectively prevented from getting caught in the clearance between the lid 20 and the main body 2. Should the fingers of the user get caught, a force that acts on the fingers when the fingers get caught can be made small. Where the slide mechanism 40-2 is equipped with the above-described resistance-force generating portion constituted by the frictional surface 46 or the inclined surface 47, it is possible to eliminate the torque-generating type bearing 32.

<Third Embodiment>

There will be next explained a third embodiment of the present invention. In the following explanation and drawings of the third embodiment, the same reference numerals as used in the first embodiment are used to identify the corresponding components, and detailed explanation is dispensed with. Details other than those explained below are the same as in the first embodiment.

Figure 8A:
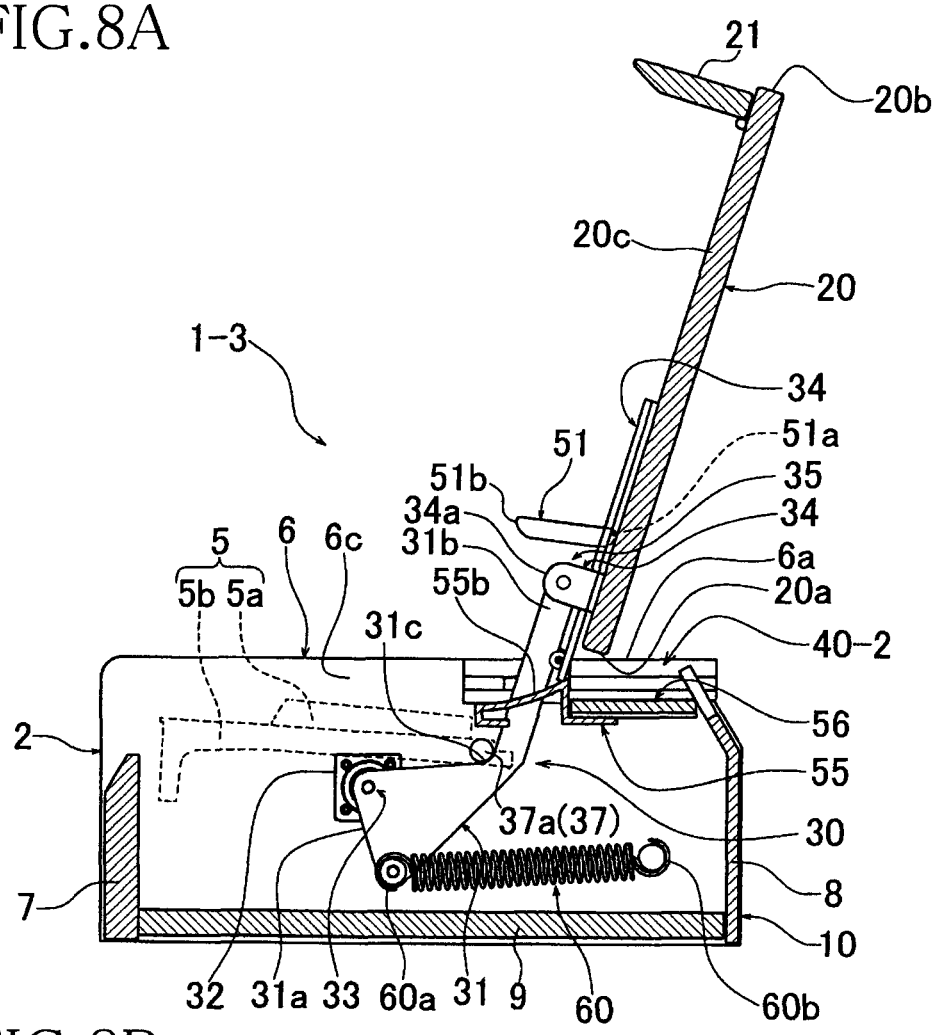
FIG. 8 is a view showing a detailed structure of a lid opening/closing mechanism according to a third embodiment of the present invention and is a side cross-sectional view of a keyboard musical instrument.
Figure 8B:
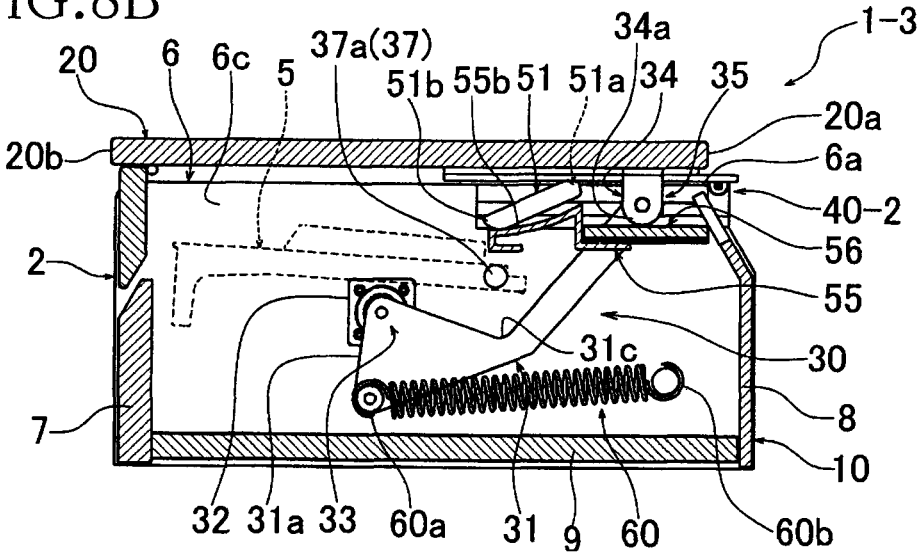

FIG. 8 is a view showing a detailed structure of a lid opening/closing mechanism according to the third embodiment and is a side cross-sectional view of a keyboard musical instrument 1-3. In the lid opening/closing mechanism according to the third embodiment, a coil spring (elastic member) 60 configured to generate a force in a direction in which the lid 20 is moved toward the open position is attached between each connecting member 31 and the main body 2. The coil spring 60 functions as a force applying portion configured to apply, to the lid 20, the force in the direction in which the lid 20 is moved from the closed position to the open position. The coil spring 60 has one end portion 60*a* attached to the connecting member 31 and the other end portion 60*b* attached to the inner side surface 6*c* of the side plate 6. Accordingly, the coil spring 60 is disposed under tension between the main body 2 and the connecting member 31. The one end portion 31*a* of the connecting member 31 near to the first pivotally-support portion 33 is formed as a base of a generally isosceles triangle having an apex at the bent portion 31*c*. At one angular portion of the base, the first pivotally-support portion 33 is disposed. At another angular portion of the base, the one end portion 60*a* of the coil spring 60 is attached. The one end portion 60*a* of the coil spring 60 attached to the connecting member 31 is fixed at a position which is more frontward than the other end portion 60*b* attached to the inner side surface 6*c* of the side plate 6 of the main body 2. In the arrangement, the force in the direction in which the lid 20 is moved toward the open position is applied to the connecting member 31 owing to the tension of the coil spring 60.

In the lid opening/closing mechanism according to the present embodiment, the force in the direction in which the lid 20 is moved toward the open position is applied to the connecting member 31 owing to the tension of the coil spring 60, in both of the movement of the lid 20 from the closed position to the open position and the movement of the lid 20 from the open position to the closed position. The arrangement reduces a force required for moving the lid 20 to the open position. Further, together with the action of the torque-generating type bearing 32, there is generated a resistance force against relative rotation between the main body 2 and the connecting member 31 and relative rotation between the lid 20 and the connecting member 31, whereby the motion of the lid 20 in the opening/closing operation is made slow. Therefore, the fingers of the user or the like are more effectively prevented from getting caught in the clearance between the lid 20 and the main body 2. Should the fingers of the user get caught, a force that acts on the fingers when the fingers get caught can be made small. Further, the lid 20 is prevented from being abruptly moved in the opening/closing operation, so that the opening/closing operation of the lid 20 can be more stabilized.

The attachment position of the coil spring 60 to the connecting member 31 may be any position other than the position described above, provided that the positions of the first pivotally-support portion 33 and the second pivotally-support portion 35 in the connecting member 31 are excluded and the force in the direction in which the lid 20 is moved toward the open position is generated.

<Fourth Embodiment>

There will be next explained a fourth embodiment of the present invention. In the following explanation and drawings of the fourth embodiment, the same reference numerals as used in the first embodiment are used to identify the corresponding components, and detailed explanation is dispensed with. Details other than those explained below are the same as in the first embodiment.

Figure 9A:
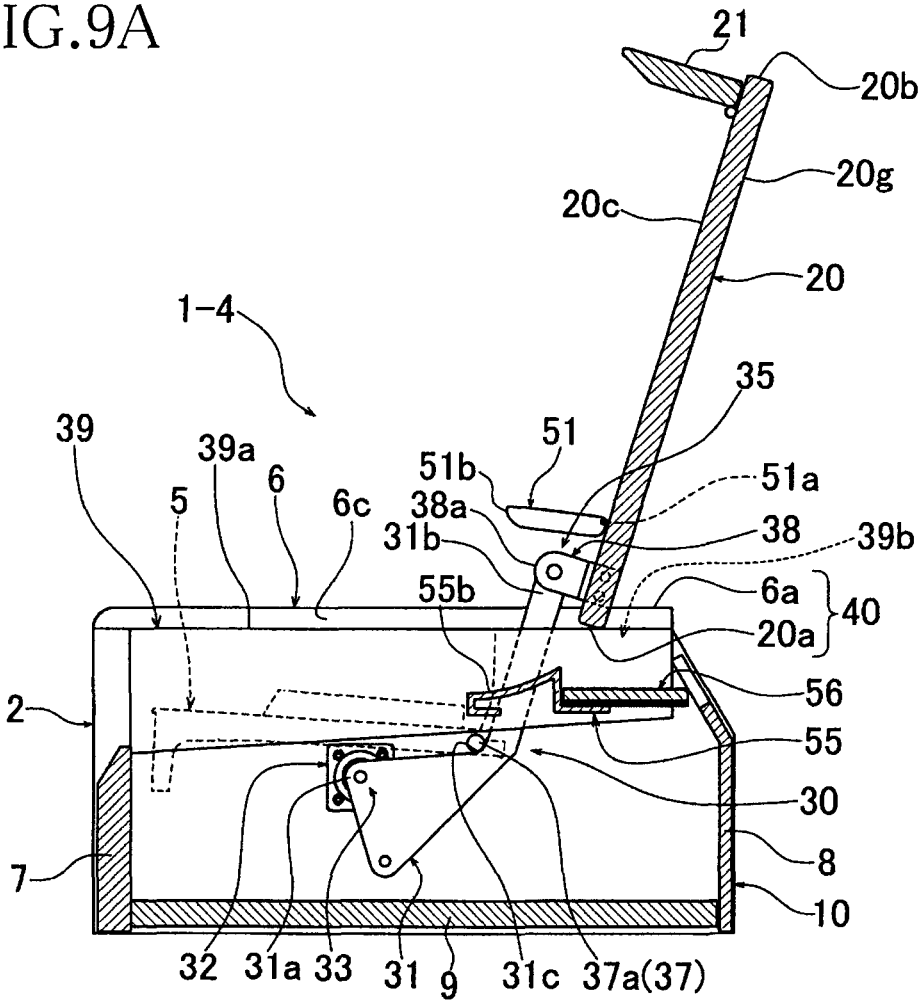
FIG. 9 is a view showing a lid opening/closing mechanism according to a fourth embodiment of the present invention and is a side cross-sectional view of a keyboard musical instrument.
Figure 9B:
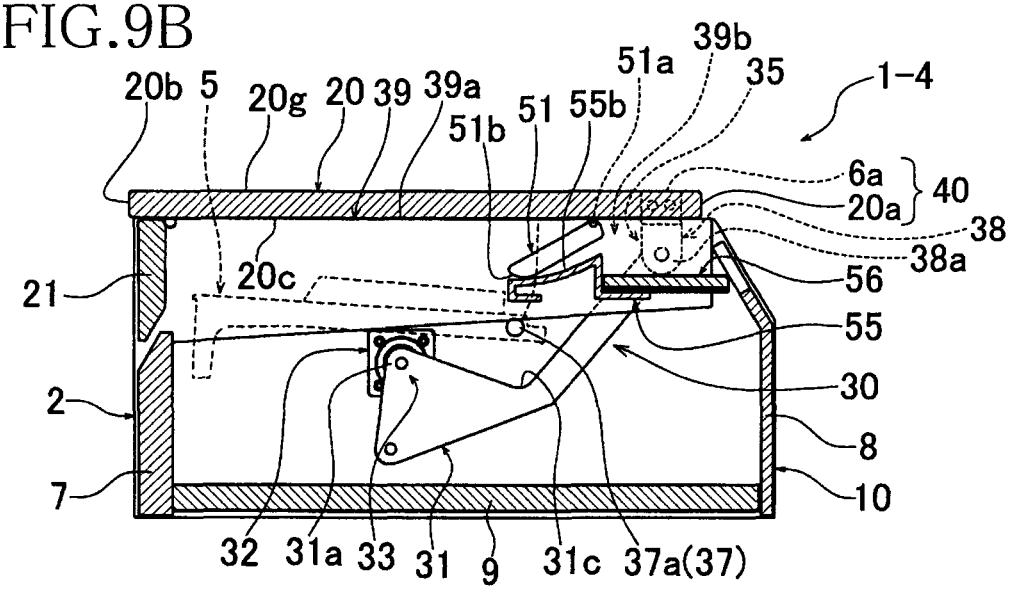
Figure 10:
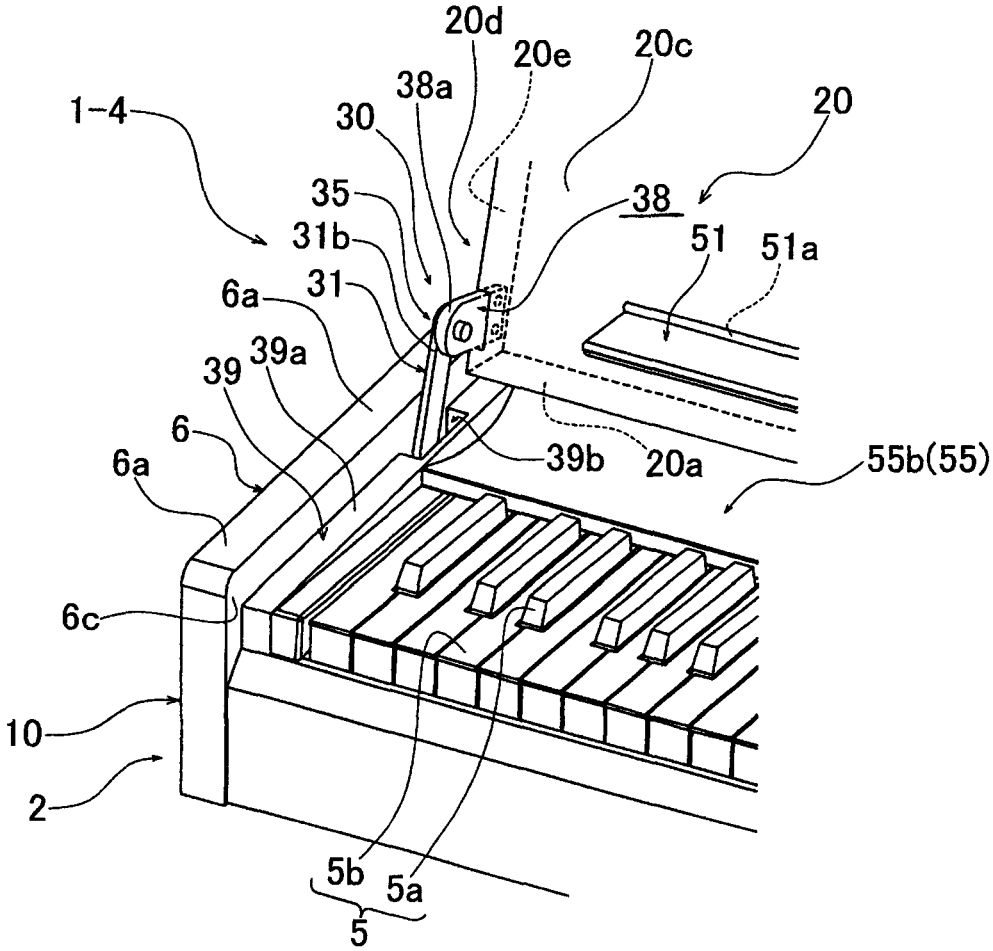
FIG. 10 is a view showing a detailed structure of the lid opening/closing mechanism according to the fourth embodiment and is a partially enlarged perspective view showing one side portion of a main body of the keyboard musical instrument.

Each of FIGS. 9 and 10 is a view showing a keyboard musical instrument 1-4 equipped with a lid opening/closing mechanism according to the fourth embodiment. More specifically, FIG. 9 is a side cross-sectional view of the keyboard musical instrument 1-4, and FIG. 10 is a partly enlarged perspective view showing one side portion of the main body 2 of the keyboard musical instrument 1-4. The lid opening/closing mechanism according to the fourth embodiment includes attachment plates 38 each fixed to a corresponding one of widthwise end faces 20*e* of the lid 20, in place of the attachment plates 34 each fixed to the inner surface 20*c* of the lid 20 in the lid opening/closing mechanism of the first embodiment. The other end portion 31*b* of each connecting member 31 is pivotally supported with respect to the lid 20 through the attachment plate 38. That is, the second pivotally-support portion 35 in the fourth embodiment pivotally supports the other end portion 31*b* of the connecting member 31 by a support piece 38*a* provided at the attachment plate 38 fixed to the widthwise end face 20*e* of the lid 20. More specifically, the attachment plate 38 has a proximal part fixed to the widthwise end face 20*e* of the lid 20 and a distal part protruding from the inner surface 20*c* of the lid 20. The distal part of the attachment plate 38 functions as the support piece 38*a* as described below.

In the first embodiment, the portions of the inner surface 20*c* of the lid 20 corresponding to the opposite end portions 20*d*, 20*d* of the lid 20 are placed on the respective upper end faces 6*a*, 6*a* of the side plates 6, 6, in the state in which the lid 20 is located at the closed position. In the present fourth embodiment, the portions of the inner surface 20*c* of the lid 20 corresponding to the opposite end portions 20*d*, 20*d* of the lid 20 are placed on respective upper end faces 39*a*, 39*a* of lid rest plates 39, 39 attached to the inner side surfaces 6*c*, 6*c* of the side plates 6, 6, in the state in which the lid 20 is located at the closed position. In FIGS. 9 and 10, the side plate 6, the lid rest plate 39, and the attachment plate 38 at the left-side end of the main body 2 are illustrated.

As shown in FIG. 10, the attachment plate 38 is a thin plate-like member. The proximal part of the attachment plate 38 is fixed by screws (not shown) to the widthwise end face 20*e* of the lid 20 while the distal part of the attachment plate 38 forms the above-indicated support piece 38*a* which protrudes from the inner surface 20*c* of the lid 20 for pivotally supporting the connecting member 31. In the structure shown in FIG. 10, a recess is formed in the widthwise end face 20*e* of the lid 20, and the attachment plate 38 is fitted in the recess so as to be fixed. The arrangement prevents the attachment plate 38 from protruding from the widthwise end face 20*e* of the lid 20. Alternatively, while not shown, a slight spacing may be formed between the widthwise end face 20*e* of the lid 20 and the side plate 6, and the attachment plate 38 may be disposed in the spacing. The shape and the pivotally supporting structure of the support piece 38*a* indicated above are similar to those of the support piece 34*a* in the first embodiment.

The lid rest plate 39 attached to the inner side surface 6*c* of the side plate 6 is a plate-like member having the same thickness as the side plate 6, for instance. The upper end face 39*a* of the lid rest plate 39 is a flat surface. The lid rest plate 39 is attached to the side plate 6 so as to extend in the longitudinal direction of the keys 5*a*, 5*b* at a height position at which the upper end face 39*a* of the lid rest plate 39 is lower than the upper end face 6*a* of the side plate 6 by an amount corresponding the thickness of the lid 20. The lid rest plate 39 is fixed by a plurality of screws (not shown) to the inner side surface 6*c* of the side plate 6. Further, there is formed, between the inner side surface 6*c* of the side plate 6 and the lid rest plate 39, an accommodating portion 39*b* for accommodating the connecting member 31 and the support piece 38*a* of the attachment plate 38. The accommodating portion 39*b* is a rectangular opening defined by the inner side surface 6*c* of the side plate 6 and a recess formed in the lid rest plate 39 and is open to upper and lower surfaces of the lid rest plate 39. The accommodating portion 39*b* permits the connecting member 31 to insert therethrough such that the connecting member 31 extends from a lower side of the lid rest plate 39 toward its upper side. The accommodating portion 39*b* is configured to accommodate the support piece 38*a* of the attachment plate 38 in the state in which the lid 20 is located at the closed position. In the lid opening/closing mechanism according to the present embodiment, the side plate 6 and the lid rest plate 39 constitutes a side wall portion, and the upper end face 39*a* of the lid rest plate 39 corresponds to "the upper end face of the side wall portion" of the present invention.

In the lid opening/closing mechanism constructed as described above, the lid 20 is located, in a state shown in FIG. 9B, at the closed position at which the space in the casing 10 above the keyboard 5 is completely closed, namely, the lid 20 is fully closed so as to cover the keyboard 5. In this state, the portions of the inner surface 20*c* of the lid 20 corresponding to the opposite end portions 20*d*, 20*d* of the lid 20 are placed on the respective upper end faces 39*a*, 39*a* of the lid rest plates 39, 39, and an outer surface (upper surface) 20*g* of the lid 20 is flush with and contiguous to the upper end faces 6*a*, 6*a* of the side plates 6, 6.

When the front end portion 20*b* of the lid 20 is lifted upward from the state shown in FIG. 9B, the lid 20 pivots and the space in the casing 10 above the keyboard 5 is gradually opened, namely, the keyboard 5 is gradually uncovered. On this occasion, when the second pivotally-support portion 35 of the connecting member 31 pivots frontward about the first pivotally-support portion 33 as a pivot point, the rear end portion 20*a* of the lid 20 slidingly moves on the upper end faces 39*a* of the lid rest plates 39 (more specifically, on a rear-side end part of each upper end face 39*a*), in the direction from the rear end portion of the main body 2 to the front end portion thereof. As a result, the front end portion 20*b* of the lid 20 pivots upward about the second pivotally-support portion 35 as a pivot point. Finally, the intermediate part of the connecting member 31 comes into abutting contact with the engagement member 37*a* of the stopper portion 37 as shown in FIG. 9A, and the connecting member 31 and the lid 20 stop moving. At this position, the lid 20 is fully opened, namely, the lid 20 is located at the open position.

<Fifth Embodiment>

There will be next explained a fifth embodiment of the present invention. In the following explanation and drawings of the fifth embodiment, the same reference numerals as used in the first embodiment are used to identify the corresponding components, and detailed explanation is dispensed with. Details other than those explained below are the same as in the first embodiment.

Figure 11:
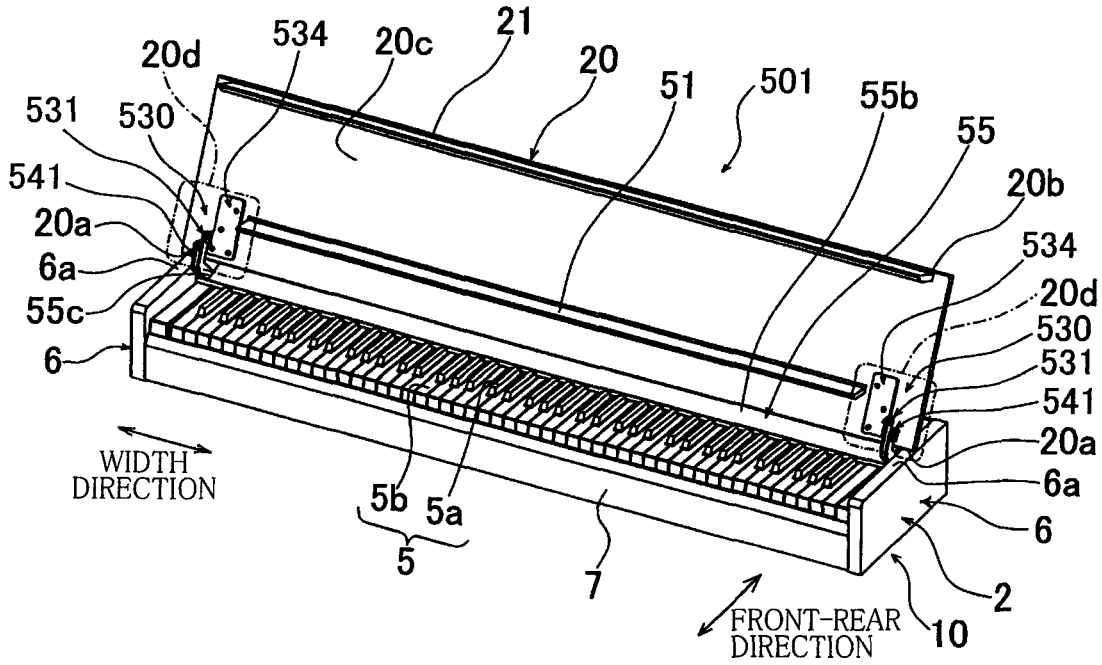
FIG. 11 a perspective view showing one example of an overall structure of a keyboard musical instrument equipped with a lid opening/closing mechanism according to a fifth embodiment of the present invention.
Figure 12:
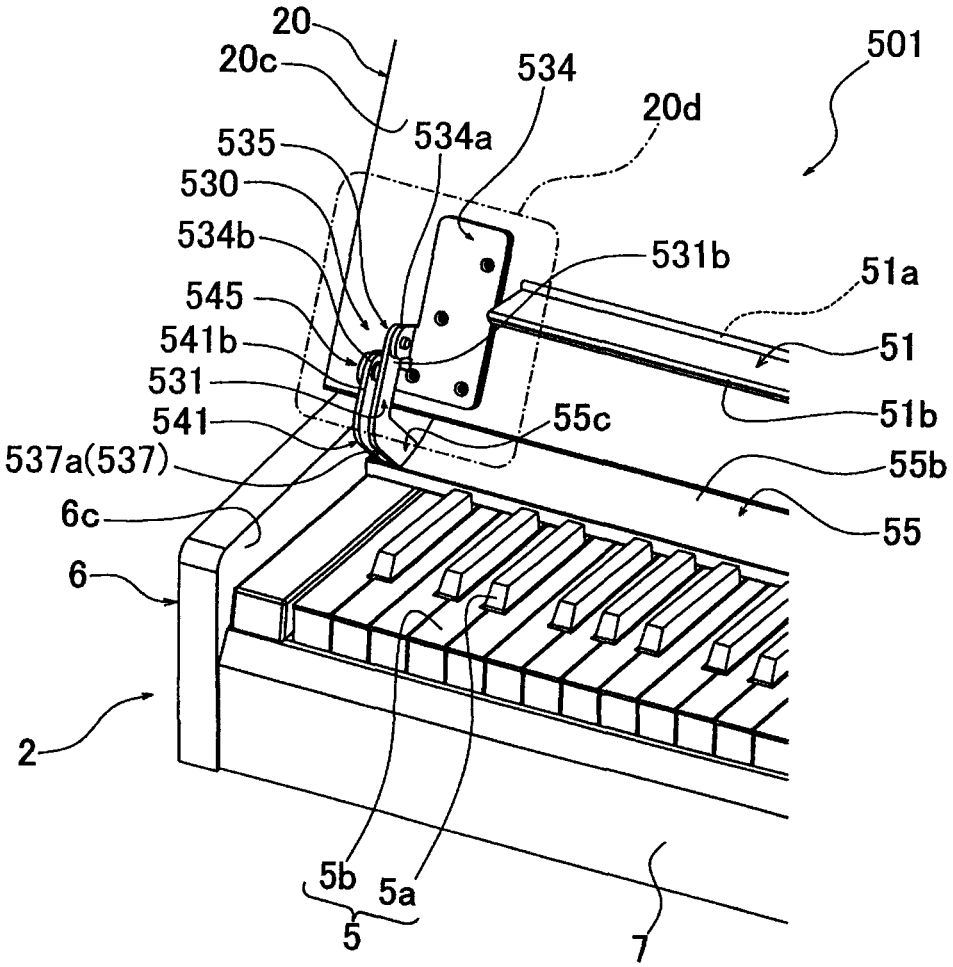
FIG. 12 is a view showing a detailed structure of the lid opening/closing mechanism of the fifth embodiment and is a partially enlarged perspective view showing one side portion of a main body of the keyboard musical instrument.
Figure 13A:
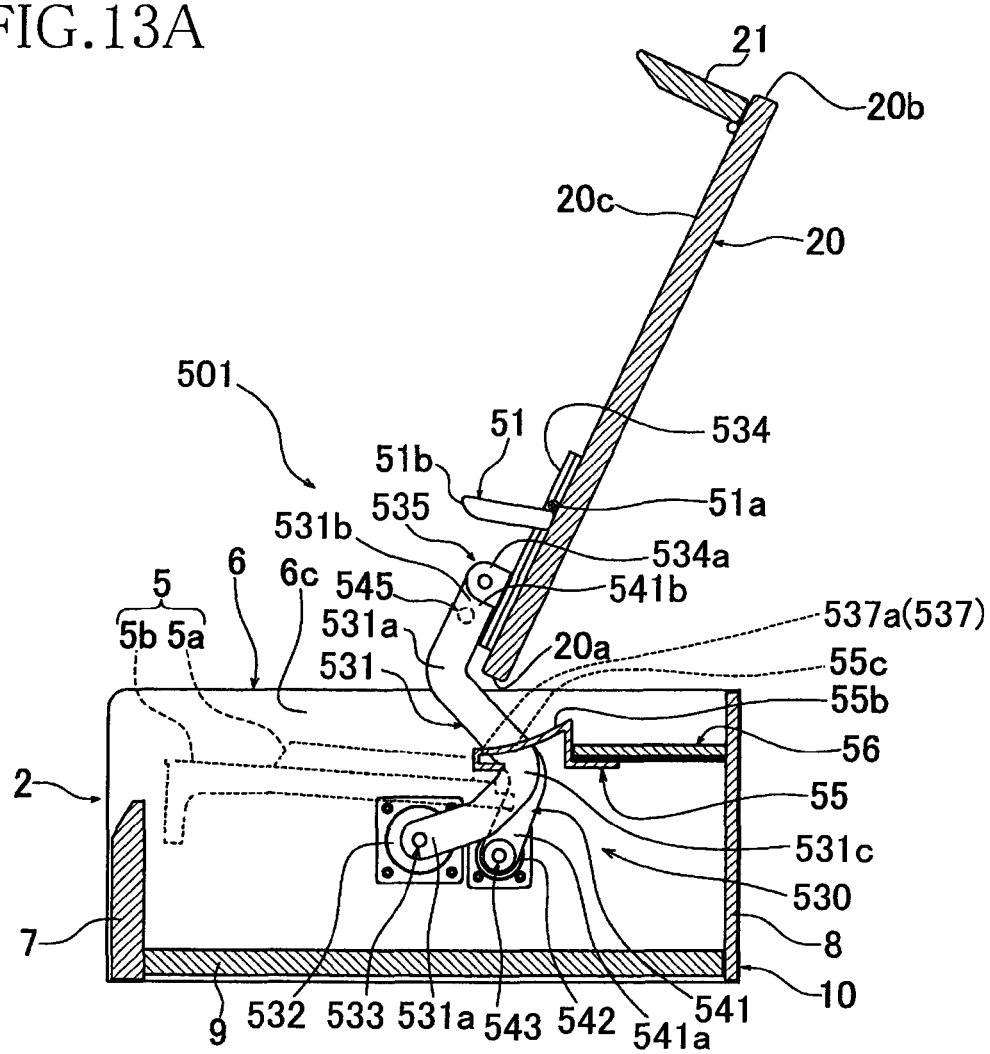
FIG. 13 is a view showing a detailed structure of a lid opening/closing mechanism according to the fifth embodiment and is a side cross-sectional view of the keyboard musical instrument.

FIG. 11 a perspective view showing one example of an overall structure of a keyboard musical instrument 501 equipped with a lid opening/closing mechanism according to the fifth embodiment of the present invention. FIG. 12 is a view showing a detailed structure of the lid opening/closing mechanism of the fifth embodiment and is a partly enlarged perspective view showing one side portion of the main body 2 of the keyboard musical instrument 501. FIG. 13 is a view showing a detailed structure of the lid opening/closing mechanism according to the fifth embodiment and is a side cross-sectional view of the keyboard musical instrument 501. FIG. 13A shows a state in which the lid 20 is located at the open position while 13B shows a state in which the lid 20 is located at the closed position. The keyboard musical instrument 501 of the fifth embodiment has: the main body 2 including the casing 10 and the keyboard 5 disposed in the casing 10; and a lid (keyboard lid or fall board) 20 attached to the casing 10 of the main body 2.

There are further provided connecting mechanisms 530, 530 for movably connecting the lid 20 with respect to the main body 2. Each connecting mechanism 530 is disposed between: a corresponding one of the side plates 6, 6 covering the left and right end portions of the keyboard 5; and a corresponding one of the left and right end portions 20*d*, 20*d* of the lid 20 which are opposed to the respective side plates 6, 6. In the keyboard musical instrument 501 of the fifth embodiment, each connecting mechanism 530 is disposed between: a corresponding one of the side plates 6, 6; and a corresponding one of the opposite end portions (the left and right end portions) 20*d*, 20*d* of the lid 20 in the key arrangement direction in which the keys 5*a*, 5*b* are arranged. The connecting mechanism 530, 530 have constituent components common to each other and have left-right symmetrical configurations and disposition structures relative to each other. Accordingly, the following explanation will be made with respect to one connecting mechanism 530. Each connecting mechanism 530 includes a first connecting member 531 and a second connecting member 541 which are formed of respective long plate-like members having mutually different lengths and which are attached between the side plate 6 and the end portion 20*d* of the lid 20.

As described above, the first connecting member 531 and the second connecting member 541 are formed of the respective long plate-like members. The first connecting member 531 has longitudinally opposite end portions 531*a*, 531*b*. More specifically, in the first connecting member 531, one of the longitudinally opposite end portions nearer to the main body 2, i.e., one end portion 531*a*, is pivotally supported by a third pivotally-support portion 533 provided on the inner side surface 6*c* of the side plate 6 while the other of the longitudinally opposite end portions nearer to the lid 20, i.e., the other end portion 531*b*, is pivotally supported by a fourth pivotally-support portion 535 provided on the inner surface 20*c* of the lid 20 facing toward the keyboard 5, at a corresponding one of the end portions 20*d* of the lid 20 in the width direction. The second connecting member 541 has longitudinally opposite end portions 541*a*, 541*b*. More specifically, in the second connecting member 541, one of the longitudinally opposite end portions nearer to the main body 2, i.e., one end portion 541*a*, is pivotally supported by a fifth pivotally-support portion 543 provided on the inner side surface 6*c* of the side plate 6 so as to be adjacent to the third pivotally-support portion 533 while the other of the longitudinally opposite end portions nearer to the lid 20, i.e., the other end portion 541*b*, is pivotally supported by a sixth pivotally-support portion 545 provided on the inner surface 20*c* of the lid 20 at a corresponding one of the end portions 20*d* of the lid 20 so as to be adjacent to the fourth pivotally-support portion 535.

The third pivotally-support portion 533 pivotally supports, with respect to the inner side surface 6*c* of the side plate 6, the one end portion 531*a* of the first connecting member 531 about a rotation axis whose axial direction coincides with the width direction of the main body 2. Similarly, the fifth pivotally-support portion 543 pivotally supports, with respect to the inner side surface 6*c* of the side plate 6, the one end portion 541*a* of the second connecting member 541 about the rotation axis. Further, the fourth pivotally-support portion 535 pivotally supports, with respect to the inner surface 20*c* of the lid 20, the other end portion 531*b* of the first connecting member 531 about a rotation axis whose axial direction coincides with the width direction (the left-right direction) of the lid 20. Similarly, the sixth pivotally-support portion 545 pivotally supports, with respect to the inner surface 20*c* of the lid 20, the other end portion 541*b* of the second connecting member 541 about the rotation axis. More specifically, the third pivotally-support portion 533 pivotally supports the one end portion 531*a* of the first connecting member 531 by a torque-generating type bearing 532 fixed to the inner side surface 6*c* of the side plate 6 while the fifth pivotally-support portion 543 pivotally supports the other end portion 541*a* of the second connecting member 541 by a torque-generating type bearing 542 fixed to the inner side surface 6*c* of the side plate 6. The torque-generating type bearings 532, 542 will be explained later. Further, the fourth pivotally-support portion 535 pivotally supports the other end portion 531*b* of the first connecting member 531 by a support piece 534*a* provided on an attachment plate 534 which is fixed by screwing to the inner surface 20*c* of the lid 20 while the sixth pivotally-support portion 545 pivotally supports the other end portion 541*b* of the second connecting member 541 by another support piece 534*b* provided on the attachment plate 534.

The first connecting member 531 is a thin plate whose longitudinal direction extends from the third pivotally-support portion 533 to the fourth pivotally-support portion 535, and has, at its intermediate portion between the third pivotally-support portion 533 and the fourth pivotally-support portion 535, two bent portions 531*c*, 531*d* which are bent in mutually opposite directions in one plane. Each of the bent portions 531*c*, 531*d* is bent into a dog-legged or a V-like shape. The first connecting member 531 is attached such that its surface is parallel to the inner side surface 6*c* of the side plate 6 and such that an inner side of the bent portion 531*c* nearer to the third pivotally-support portion 533 is directed upward and frontward. The third pivotally-support portion 533 is located at a position which is lower and more frontward than the fourth pivotally-support portion 535. In other words, the third pivotally-support portion 533 is located more frontward than the fourth pivotally-support portion 535 in the front-rear direction of the main body 2 and is located more downward than the fourth pivotally-support portion 535 in the vertical direction.

The second connecting member 541 is a thin plate whose longitudinal direction extends from the fifth pivotally-support portion 543 to the sixth pivotally-support portion 545, and has, at its intermediate portion between the fifth pivotally-support portion 543 and the sixth pivotally-support portion 545, two bent portions 541*c*, 541*d* which are bent in mutually opposite directions in one plane. Each of the bent portions 541*c*, 541*d* is bent into a dog-legged or a V-like shape. The second connecting member 541 is attached such that its surface is parallel to the inner side surface 6*c* of the side plate 6 and such that an inner side of the bent portion 541*c* nearer to the fifth pivotally-support portion 543 is directed upward and frontward. The fifth pivotally-support portion 543 is located at a position which is lower and more frontward than the sixth pivotally-support portion 545. In other words, the fifth pivotally-support portion 543 is located more frontward than the sixth pivotally-support portion 545 in the front-rear direction of the main body 2 and is located more downward than the sixth pivotally-support portion 545 in the vertical direction.

The first connecting member 531 and the second connecting member 541 are disposed along the inner side surface 6*c* of the side plate 6, so as to be arranged in the lateral direction of the main body 2. In the present embodiment, the second connecting member 541 is disposed on an outer side (i.e., on a side nearer to the inner side surface 6*c*) while the first connecting member 531 is disposed on an inner side (i.e., on a side remote from the inner side surface 6*c*). The third pivotally-support portion 533 and the fifth pivotally-support portion 543 are disposed on the inner side surface 6*c* of the side plate 6 so as to be arranged in the front-rear direction, in a plane which is substantially parallel to the performance-side surface of the keyboard 5, the longitudinal direction of the keys 5*a*, 5*b*, and the upper surface of the main body 2. In the present embodiment, the third pivotally-support portion 533 is disposed so as to be nearer to the front end portion of the main bod 2 while the fifth pivotally-support portion 543 is disposed so as to be nearer to the rear end portion of the main body 2. Further, the fourth pivotally-support portion 535 and the sixth pivotally-support portion 545 are disposed so as to be arranged in a direction from the front end portion 20*b* of the lid 20 toward the rear end portion 20*a* (i. e., the front-rear direction) , in a plane along the inner surface 20*c* of the lid 20. In the present embodiment, the fourth pivotally-support portion 535 is disposed on a front side (i.e., on a side nearer to the front end portion 20*b* of the lid 20) while the sixth pivotally-support portion 545 is disposed on a rear side (i.e., on a side nearer to the rear end portion 20*a* of the lid 20). Each of the third pivotally-support portion 533 and the fifth pivotally-support portion 543 is a stationary-side pivot point whose relative position with respect to the main body 2 is stationary or fixed. Each of the fourth pivotally-support portion 535 and the sixth pivotally-support portion 545 is a movable-side pivot point which is relatively displaceable with respect to the main body 2. As explained above, the performance-side surface of the keyboard 5 refers to the substantially horizontal surface including the upper-surface portions of the keys 5*a*, 5*b* touched by the fingers of the performer. Depending upon the type or form of the keyboard 5, the upper-surface portions of the keys 5*a*, 5*b* are slightly inclined in the front-rear direction of the main body 2. In such a case, the performance-side surface of the keyboard 5 also refers to the substantially horizontal surface including the upper-surfaces portions of the keys 5*a*, 5*b*.

The torque-generating type bearing 532 disposed at the third pivotally-support portion 533 and the torque-generating type bearing 542 disposed at the fifth pivotally-support portion 543 have a structure similar to that of the bearing 32 in the first embodiment.

In place of the above-described oil damper mechanism, each of the bearings 532, 542 may be a rotary damper mechanism (rotational friction mechanism) configured to generate a frictional force by sliding of a plurality of resin components disposed around a rotation axis.

The lid opening/closing structure according to the present embodiment has stopper portions 537 each for stopping the movements of the first connecting member 531 and the second connecting member 541 in the state in which the lid 20 is located at the open position. The stopper portion 537 has an engagement part 537 provided at a front end (a front edge) of the cutout 55*c* of the panel member 55 for permitting end faces of the respective first and second connecting members 531, 541 to come into contact with the engagement part 537. The engagement part 537*a* is configured to limit or stop the pivotal movement of the first connecting member 531 about the third pivotally-support portion 533 and the pivotal movement of the second connecting member 541 about the fifth pivotally-support portion 543, by contact of an inner face of the bent portion 531*c* of the first connecting member 531 and an inner face of the bent portion 541*c* of the second connecting member 541 with the engagement part 537*a*, in the state in which the lid 20 is located at the open position at which the lid 20 is fully opened. That is, the engagement part 537*a* stops or limits the pivotal movements of the first and second connecting members 531, 541 at a position where the first and second connecting members 531, 541 contact the engagement part 537*a*.

Figure 13B:
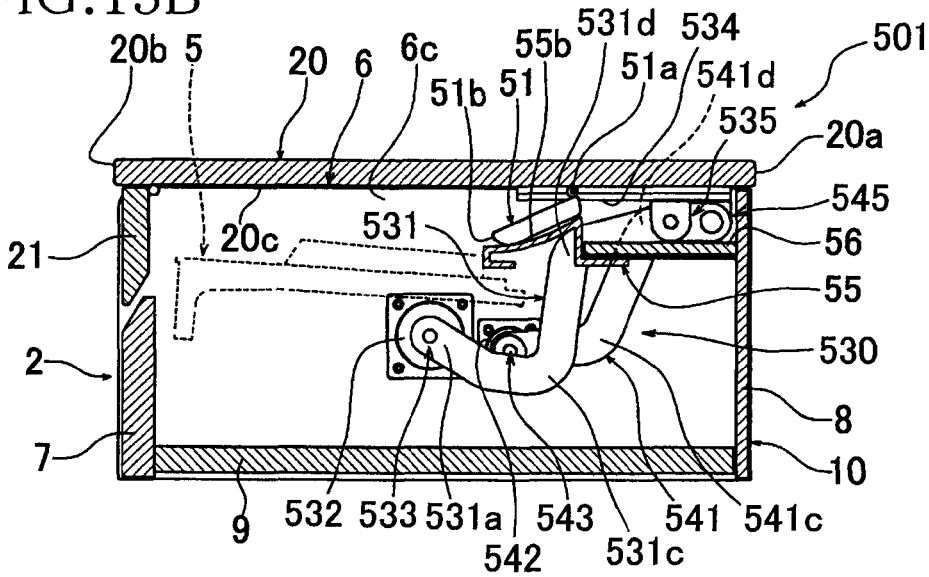
Figure 14:
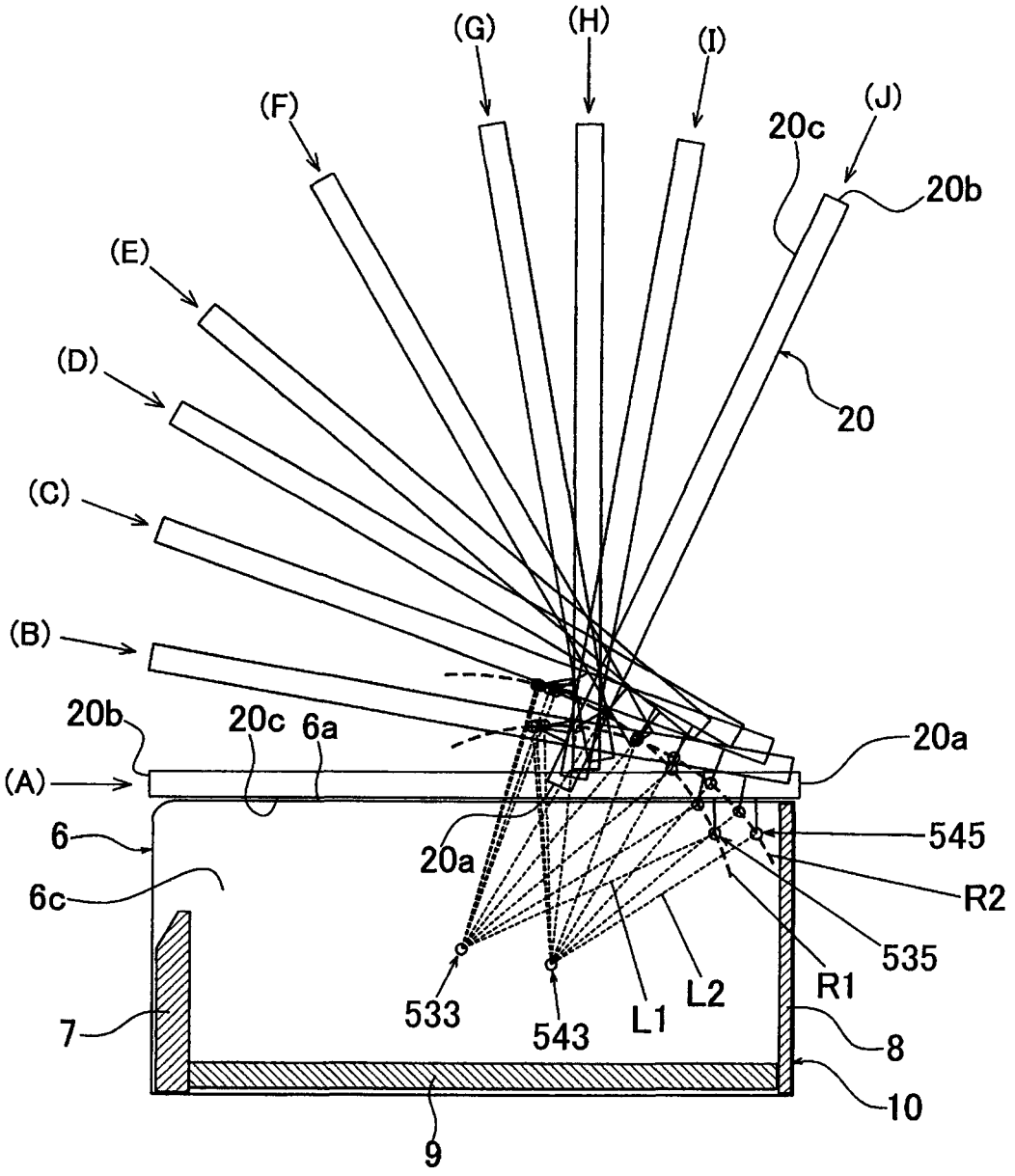
FIG. 14 is a view for explaining a motion of the lid when the lid moves between the closed position and the open position.
Figure 15A:
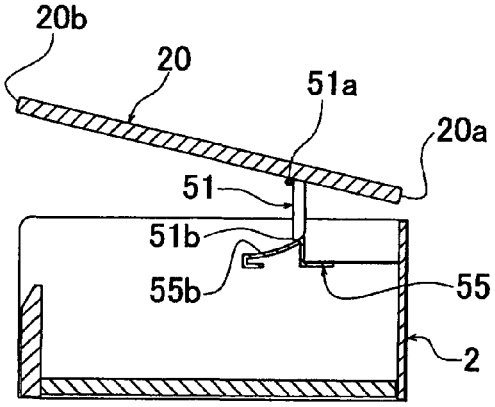
FIG. 15 is a view for explaining a motion of a music stand in association with an opening /closing operation of the lid.
Figure 15B:
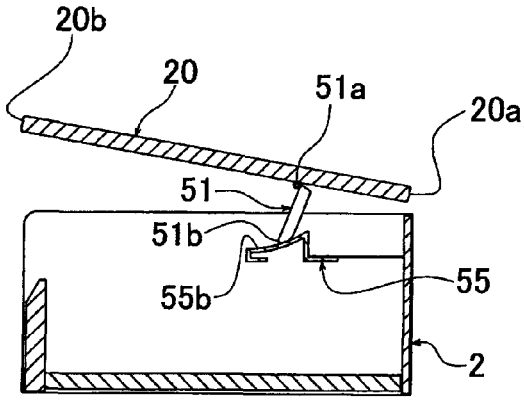
Figure 15C:
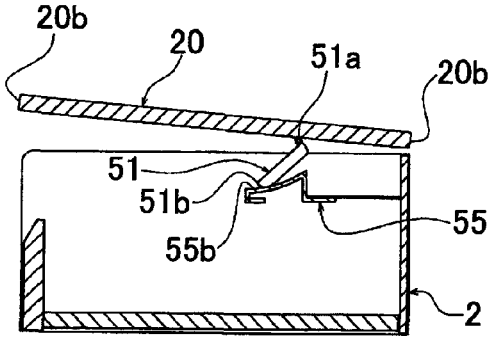
Figure 15D:
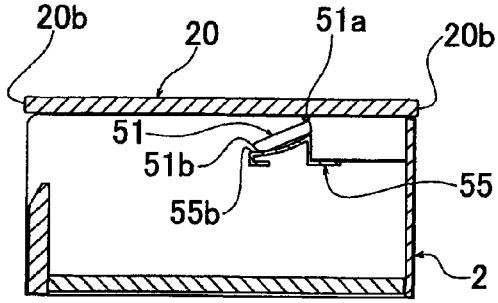

FIG. 14 is a view for explaining motions of various portions when the lid 20 moves between the closed position and the open position. In FIG. 14, only principal portions relating to the opening/closing operation of the lid 20, such as the third, fourth, fifth, and sixth pivotally-support portions 533, 535, 543, 545 which pivotally support the opposite end portions of the first and second connecting members 531, 541, are schematically illustrated. Further, in FIG. 14, there are successively indicated loci of the third, fourth, fifth, and sixth pivotally-support portions 533, 535, 543, 545 and a locus of the lid 20 when the lid 20 moves between the open position and the closed position. The motions of various portions in association with the opening/closing of the lid 20 will be explained with reference to FIG. 14, in addition to FIG. 12 and FIG. 13. Initially, in a state (A) shown in FIG. 14, the lid 20 is located at the closed position at which the lid 20 is closed so as to completely cover the keyboard 5, namely, at which the space in the casing 10 above the keyboard 5 is completely closed. In this state, the portions of the inner surface 20*c* of the lid 20 corresponding to the opposite end portions 20*d*, 20*d* of the lid 20 are placed on the upper end faces 6*a*, 6*a* of the side plates 6, 6. When the front end portion 20*b* of the lid 20 is lifted upward from this state, the lid 20 pivots sequentially in the order from (B) to (I) in FIG. 14, so that the space in the casing 10 above the keyboard 5 is gradually opened, namely, the keyboard 5 is gradually uncovered. On this occasion, the fourth pivotally-support portion 535 pivots frontward and upward about the third pivotally-support portion 533 as a pivot point, and the sixth pivotally-support portion 545 pivots frontward and upward about the fifth pivotally-support portion 543 as a pivot point. At the same time, the rear end portion 20*a* of the lid 20 moves in the direction from the rear end portion of the main body 2 toward the front end portion thereof.

The lid 20 moves from the closed position to the open position as described above, whereby the lid 20 pivots about a position near to the rear end portion 20*a* as a pivot point in a region above the main body 2, such that the front end portion 20*b* of the lid 20 is lifted from a lower front side toward an upper rear side. Finally, the first connecting member 531, the second connecting member 541, and the lid 20 stop moving at the position shown in FIG. 13A at which the first connecting member 531 and the second connecting member 541 come into contact with the stopper portion 537 (the engagement part 537*a*). At this position, the lid 20 is located at the open position at which the lid 20 is fully opened, as shown in (J) in FIG. 14. At the open position, the lid 20 disposed on the upper surface of the main body 2 is in a posture in which the rear end portion 20*a* is located slightly frontward as compared with the front end portion 20*b*, such that the inner surface 20*c* of the lid 2 is slightly inclined rearward. At the open position, the front end portion 20*b* of the lid 20 is located at the same position as or frontward of a rear-side end of the main body 2, and therefore the front end portion 20*b* of the lid 20 does not protrude beyond the rear-side end of the main body 2. The position of the lid 20 shown in FIG. 13A and (J) in FIG. 14 is the open position at which the lid 20 is completely opened with respect to the main body 2, in other words, the position at which the lid 20 is opened to a maximum extent with respect to the main body 2 (i.e., the position at which a degree of opening of the lid 20 with respect to the main body 2 is the largest). In this instance, the position at which the lid 20 is opened to a maximum extent with respect to the main body 2 id defined by: the engagement parts 537*a* of the stopper portions 537 each of which comes into contact with the first connecting member 531 and the second connecting member 541; and the attachment plates 534 to each of which the first connecting member 531 and the second connecting member 541 are attached, as shown in FIG. 13A and (J) in FIG. 14

On the other hand, when the front end portion 20*b* of the lid 20 located at the open position shown in (J) in FIG. 14 is pulled forward, the lid 20 moves toward the closed position. In this instance, contrary to the movement of the lid 20 toward the open position, the lid 20 pivots sequentially in the order from (I) to (B) in FIG. 14, so that the space in the casing 10 above the keyboard 5 is gradually closed, namely, the keyboard 5 is gradually covered. On this occasion, the front end portion 20*b* of the lid 20 pivots about the position near to the rear end portion 20*a* as a pivot point, from the upper rear side toward the lower front side. Further, the rear end portion 20*a* of the lid 20 moves from the front end portion of the main body 2 toward the rear end portion thereof. Finally, as shown in (A) in FIG. 14, the lid 20 is located at the closed position at which the lid 20 is fully closed so as to cover the keyboard 5, with the portions of the inner surface 20*c* of the lid 20 corresponding to the opposite end portions 20*d*, 20*d* of the lid 20 placed or rested on the upper end faces 6*a*, 6*a* of the side plates 6, 6.

In the opening/closing operation of the lid 20 described above, a locus R1 along which the fourth pivotally-support portion 535 moves is an arc of a circle whose center is the third pivotally-support portion 533, and a line L1 that connects the third pivotally-support portion 533 and the fourth pivotally-support portion 535 by the shortest distance is a radius of the circle whose center is the third pivotally-support portion 533. Further, a locus R2 along which the sixth pivotally-support portion 545 moves is an arc of a circle whose center is the fifth pivotally-support portion 543, and a line L2 that connects the fifth pivotally-support portion 543 and the sixth pivotally-support portion 545 by the shortest distance is a radius of the circle whose center is the fifth pivotally-support portion 543. The locus R1 of the fourth pivotally-support portion 535 the locus R2 of the sixth pivotally-support portion 545 intersect each other in the movement of the lid 20 from the closed position to the open position. Further, in the movement of the lid 20 from the closed position to the open position the lid 20, a positional relationship between the fourth pivotally-support portion 535 and the sixth pivotally-support portion 545 in both of an up-down relation and a front-rear relation with respect to the main body 2 is reversed. Moreover, the straight line L1 that connects the third pivotally-support portion 533 and the fourth pivotally-support portion 535 and the straight line L2 that connects the fifth pivotally-support portion 543 and the sixth pivotally-support portion 545 are always non-parallel to each other during the movement of the lid 20 from the closed position to the open position.

Next, there will be explained a motion of the music stand 51 in association with the opening/closing operation of the lid 20. FIG. 15 is a view for explaining the motion of the music stand 51. In the keyboard musical instrument 501 according to the present embodiment, the music stand 51 is disposed so as to be opposed to the panel surface 55*b* as shown in FIG. 13B in the state in which the lid 20 is located at the closed position. In the movement of the lid 20 to the closed position, a distal end portion (free end) 51*b* of the music stand 51 comes into contact with the panel surface 55*b*, and the music stand 51 is automatically folded into a position along the inner surface 20*c* of the lid 20, as shown in FIGS. 15A-15D. In this arrangement, even if the user forgets to fold the music stand 51 when the lid 20 is closed, there is no risk that the lid 20 cannot be closed due to interference of the music stand 51 with the panel surface 55*b*.

The lid opening/closing mechanism according to the present embodiment has the connecting mechanisms 530, 530 each of which is of a four-point link type owing to the first connecting member 531 and the second connecting member 541. The lid 20 which moves from the open position to the closed position pivots about the position, as a pivot point, nearer to the rear end portion 20*a*, in the region above the main body 2. Accordingly, the inner surface 20*c* of the lid 20 immediately before reaching the closed position approaches the panel surface 55*b* which is substantially parallel to the performance-side surface of the keyboard 5 and the longitudinal direction of the keys 5*a*, 5*b*, not from the upper rear side in an obliquely downward direction, but from the right above so as to cover the keyboard 5, as shown in FIGS. 15A-15D. According to the structure, immediately before the lid 20 reaches the closed position, the distal end portion 51*b* of the music stand 51 attached to the inner surface 20*c* of the lid 20 comes into contact with the panel surface 55*b*, whereby the music stand 51 can be pivoted with high reliability. Therefore, by moving the lid 20 to the closed position, the music stand 51 can be automatically folded. Since the music stand 51 is configured to be folded by using the panel surface 55*b* disposed at the rear portion of the keyboard 5, the number of components of the keyboard musical instrument 501 is not increased and the structure of the keyboard musical instrument 501 does not become complicated even if the keyboard musical instrument 501 has the structure of automatically folding the music stand 51 in closing the lid 20. In addition, the opening/closing of the music stand 51 can be automatically performed using a simple bearing structure with no torque generation, without using so-called torque-generating type bearing components which are relatively expensive, as a hinge mechanism for the shaft portion 51*a* of the music stand 51.

As explained above, in the lid opening/closing mechanism according to the present embodiment, the lid 20 is connected to the main body 2 by a four-point support structure (i.e., a so-called four-bar linkage support structure using turning pairs) using the first and second connecting members 531, 541. Accordingly, the plane of the plate-like lid 20 pivots within the narrow range above the main body 2, whereby the upper portion of the casing 10 can be opened/closed. Hence, as compared with conventional lid opening/closing mechanisms, the range in which the lid 20 pivots can be made smaller, so that it is possible to prevent the lid 20 from partly protruding beyond the rear end portion of the main body 2 when the lid 20 is opened/closed. Even if the lid 20 partly protrudes beyond the rear end portion of the main body 2, the amount of protrusion can be minimized. Accordingly, the keyboard musical instrument 501 including the lid 20 opened/closed as described above ensures a space saving.

Further, the lid 20 is configured to pivot within the range of the upper portion of the main body 2 in a simplified structure in which the number of components of each of the connecting mechanisms 530 that connect the main body 2 of the keyboard musical instrument 501 and the lid 20 is reduced. Accordingly, it is possible to reduce the displacement of the position of the center of gravity of the lid 20 upon opening/closing of the lid 20, thereby permitting the opening/closing operation of the lid 20 to be easily performed.

In each connecting mechanism 530 according to the present embodiment, the third pivotally-support portion 533 and the fifth pivotally-support portion 543 are disposed so as to be located at the mutually different positions in the front-rear direction with respect to the main body 2 while the fourth pivotally-support portion 535 and the sixth pivotally-support portion 545 are disposed so as to be located at the mutually different positions in front-rear direction of the lid 20 along the surface of the lid 20. Accordingly, in the four-point support structure by the two connecting members 531,541, it is possible to realize, with the simple structure, the mechanism in which the locus R1 of the fourth pivotally-support portion 535 and the locus R2 of the sixth pivotally-support portion 545 intersect each other, in the movement in which the rear end portion 20*a* of the lid 20 is moved in the direction from the rear end portion of the main body 2 toward the front end portion thereof and in which the lid 20 is moved from the closed position to the open position. Further, the lid 20 can be smoothly moved between the closed position and the open position while making the connecting mechanism 530 compact.

In the lid opening/closing mechanism according to the present embodiment, in the state in which the lid 20 is located at the open position, each stopper portion 537 permits the first connecting member 531 and the second connecting member 541 to come into contact therewith for thereby stopping the movements of the first connecting member 531 and the second connecting member 541, so that the lid 20 can be kept located at the open position with high reliability. Accordingly, the lid 20 is prevented from falling backward at the open position. Further, at the open position of the lid 20, the lid 20 is disposed on the upper surface of the main body 2 in an inclined state in which the rear end portion 20*a* of the lid 20 is located nearer to the front end portion of the main body 2 than the front end portion 20*b* of the lid 20, whereby the lid 20 can be kept located at the open position with high stability. Accordingly, it is possible to prevent the lid 20 located at the open position from abruptly or unexpectedly being moved toward the closed position and accordingly closed.

In the lid opening/closing mechanism according to the present embodiment, the torque-generating type bearings 532, 542 are respectively provided at the third pivotally-support portion 533 and the fifth pivotally-support portion 543, each as the resistance-force generating portion for generating the resistance force against relative rotation between the main body 2 and the first connecting member 531 or the second connecting member 541. According to the arrangement, the motion of the lid 20 when the lid 20 is opened/closed is made slow owing to the resistance force against relative rotation between the main body 2 and the first connecting member 531 or the second connecting member 541, whereby it is possible to effectively prevent the user's fingers or the like from getting caught between the lid 20 and the main body 2. Further, since the lid 20 is prevented from being abruptly moved in the opening/closing operation of the lid 20, the opening/closing operation of the lid 20 can be stabilized. In the present embodiment, the bearings 532, 542 each as the resistance-force generating portion are provided at the third pivotally-support portion 533 and the fifth pivotally-support portion 543, respectively. Any one of the bearings 532, 542 may be provided. While illustration and detailed explanation are not given, the torque generating type bearing may be provided at at least one of the fourth pivotally-support portion 535 and the sixth pivotally-support portion 545, in place of the bearings 532, 542 provided at the third pivotally-support portion 533 and the fourth pivotally-support portion 535.

<Sixth Embodiment>

There will be next explained a sixth embodiment of the present invention. In the following explanation and drawing of the sixth embodiment, the same reference numerals as used in the fifth embodiment are used to identify the corresponding components, and detailed explanation is dispensed with. Details other than those explained below are the same as in the sixth embodiment.

Figure 16A:
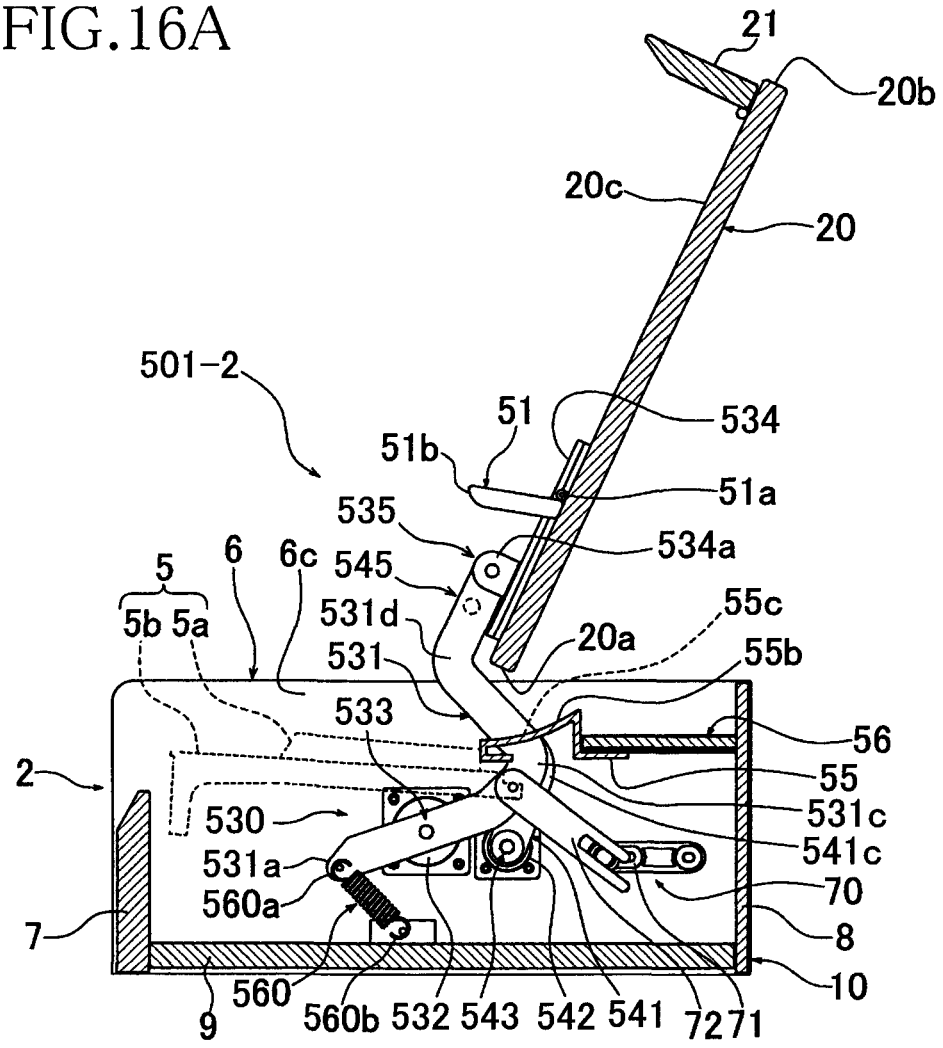
FIG. 16 is a view showing a detailed structure of a lid opening/closing mechanism according to a sixth embodiment of the present invention and is a side cross-sectional view of a keyboard musical instrument.
Figure 16B:
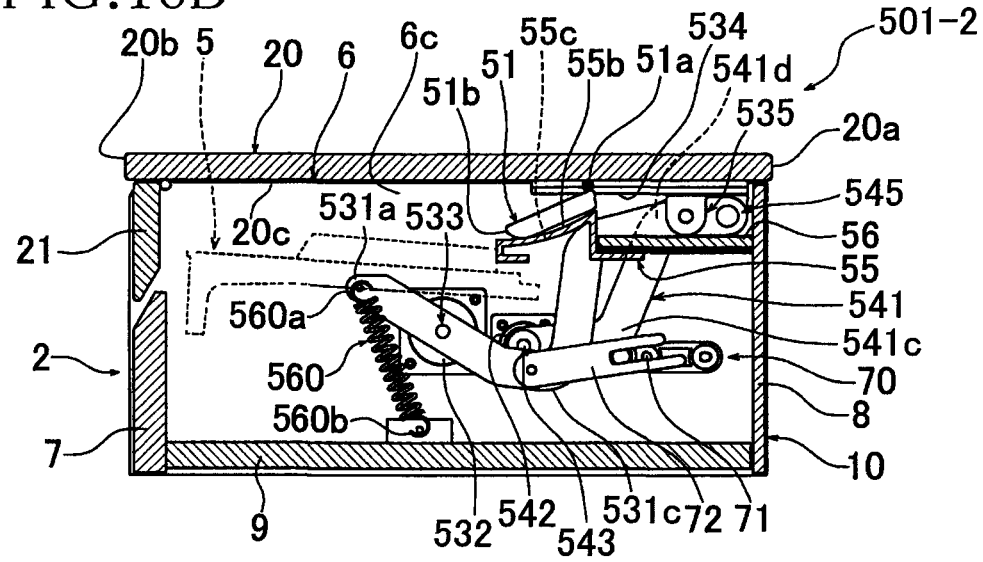

FIG. 16 is a view showing a detailed structure of a lid opening/closing mechanism according to the sixth embodiment and is a side cross-sectional view of a keyboard musical instrument 501-2. In the lid opening/closing mechanism according to the present embodiment, there is attached, between each first connecting member 531 and the main body 2, a coil spring (elastic member) 560 configured to generate, with respect to the first connecting member 531, a force in a direction in which the lid 20 is moved toward the open position. The coil spring 560 functions as a force applying portion configured to apply, to the lid 20, the force in the direction in which the lid 20 is moved from the closed position to the open position. The coil spring 560 has one end portion 560*a* attached to the first connecting member 531 and the other end portion 560*b* attached to the inner side surface 6*c* of the side plate 6. Accordingly, the coil spring 560 is disposed under tension between the main body 2 and the first connecting member 531. In the present embodiment, the third pivotally-support portion 533 is provided at a position nearer to the rear end portion of the main body 2 than the one end portion 531*a* of the first connecting member 531 on the side of the main body 2, namely, nearer to the fourth pivotally-support portion 535. Further, the one end portion 531*a* of the first connecting member 531 is distant from the third pivotally-support portion 533. The one end portion 560*a* of the coil spring 560 is attached to the one end portion 531*a* of the first connecting member 531, and the one end portion 560*a* of the coil spring 560 is fixed at a position which is more frontward than the other end portion 60*b* of the coil spring 560 attached to the main body 2. In the arrangement, the force in the direction in which the lid 20 is moved toward the open position is applied to the first connecting member 531 owing to the tension of the coil spring 560.

In the lid opening/closing mechanism according to the present embodiment, the force in the direction in which the lid 20 is moved toward the open position is applied to the first connecting member 531 owing to the tension of the coil spring 560, in both of the movement of the lid 20 from the closed position to the open position and the movement of the lid 20 from the open position to the closed position. Owing to the force generated by the coil spring 560, a force required for moving the lid 20 to the open position is made small. Further, together with the action of the torque-generating type bearings 532, 542, there are generated resistance forces against relative rotation between the main body 2 and the first connecting member 531 and relative rotation between the lid 20 and the first connecting member 531, whereby the motion of the lid 20 in the opening/closing operation is made slow. Therefore, the fingers of the user or the like are more effectively prevented from getting caught between the lid 20 and the main body 2. Should the fingers of the user get caught, a force that acts on the fingers when the fingers get caught can be made small. Further, the lid 20 is prevented from being abruptly moved in the opening/closing operation, so that the opening/closing operation of the lid 20 can be more stabilized.

The attachment position of the coil spring 560 to the first connecting member 531 may be any position other than the position described above, provided that the positions of the third pivotally-support portion 533 and the fourth pivotally-support portion 535 in the first connecting member 531 are excluded and the force in the direction in which the lid 20 is moved toward the open position is generated. In the present embodiment, the coil spring 560 is attached to the first connecting member 531. Such a coil spring for generating the force in the direction in which the lid 20 is moved toward the open position may be attached between the second connecting member 541 and the main body 2.

The lid opening/closing mechanism according to the present embodiment further has friction generating mechanisms 70 each provided between the corresponding first connecting member 531 and the main body 2, as the resistance-force generating portion for generating the resistance force against the movement of the lid 20. The friction generating mechanism 70 includes: a slide member 71 attached to the inner side surface 6*c* of the corresponding side plate 6 and configured to slidingly move along the front-rear direction of the main body 2; and a link member 72 which pivotally connects or links (for link connection) the slide member 71 and a side surface of the first connecting member 531 in the vicinity of the bent portion 531*c*. The slide member 71 is configured to generate a suitable frictional force in association with its sliding movement in the front-rear direction. According to the arrangement, when the lid 20 is opened/closed, the first connecting member 531 moves, whereby the slide member 71 slidingly moves in the front-rear direction, so as to generate a resistance force against the movement of the first connecting member 531.

The friction generating mechanism 70 constructed as described above may be configured to generate a large magnitude of frictional force at the open position and the closed position of the lid 20 and vicinities thereof. The resistance-force generating portion constituted by the friction generating mechanism 70 makes it possible to generate the resistance force against the movement of the lid 20 at the open position and the closed position of the lid 20 and vicinities thereof at which a large load acts on the user when the lid 20 is opened/closed. Therefore, the load that acts on the user when the lid 20 is opened/closed can be effectively reduced, whereby the opening/closing operation of the lid 20 can be smoothly carried out with a smaller force. Further, owing to the resistance force, the motion of the lid 20 when the lid 20 is opened/closed can be made slow, whereby the fingers of the user or the like are more effectively prevented from getting caught in the clearance between the lid 20 and the main body 2. Should the fingers of the user get caught, a force that acts on the fingers when the fingers get caught can be made small. Moreover, since the lid 20 is prevented from being abruptly moved in the opening/closing operation, the opening/closing operation of the lid 20 can be stabilized. Where the lid opening/closing mechanism is equipped with the above-described resistance-force generating portion constituted by the friction generating mechanism 70, it is possible to eliminate the torque-generating type bearings 532, 542.

While the embodiments of the present invention have been explained, it is to be understood that the present invention is not limited to the details of the illustrated embodiments, but may be otherwise embodied with various other changes and modifications within the scope of the invention defined in the attached claims and the range of technical concept described in the specification and the drawings. For instance, in the illustrated embodiments, the keyboard musical instrument to which the lid opening/closing mechanism of the invention is applied is the keyboard musical instrument of a potable type. The lid opening/closing mechanism according to the present invention may be applied to a standing-type (large-sized) keyboard musical instrument having leg portions, other than the portable-type keyboard musical instrument.

In the illustrated first through fourth embodiments, the second pivotally-support portion 35 provided at a corresponding one of the opposite end portions 20*d* of the lid 20 in the width direction of the lid 20 is located at a position in the inner surface 20*c* of the lid 20 nearer to the rear end portion 20*a* or at a position in the inner surface 20*c* of the lid 20 nearer to the end face 20*e* of the lid 20. The second pivotally-support portion 35 may be provided at any position other than those in the illustrated embodiments, as long as each second pivotally-support portion 35 is provided at the corresponding one of the opposite end portions 20*d* of the lid 20 in the width direction of the lid 20 (i.e., in the key arrangement direction). For instance, the second pivotally-support portion 35 may be provided at a position in the inner surface 20*c* of the lid 20 intermediate between the rear end portion 20*a* and the front end portion 20*b* or a position in the end face 20*e* of the lid 20 intermediate between the rear end portion 20*a* and the front end portion 20*b*.

In the illustrated first through fourth embodiments, each of the connecting mechanisms 30, 30 is provided between a corresponding one of the side plates 6, 6 of the casing and a corresponding one of the opposite end portions 20*d*, 20*d* of the lid 20 in the width direction of the lid 20. The connecting mechanism 30 according to the present invention may be provided for only one end portion of the lid in the width direction of the lid, as long as the lid is slidingly movable. In the illustrated embodiment, the guide groove (concave portion) 43*a* may be provided at the lid 20 in place of the side plate 6, and the slide protrusion (convex portion) 45*a* may be provided at the side plate 6 in place of the lid 20.

In the illustrated fifth and sixth embodiments, each of the fourth pivotally-support portion 535 and the sixth pivotally-support portion 545 provided at a corresponding one of the opposite end portions 20*d*, 20*d* of the lid 20 in the width direction of the lid 20 is disposed at a position in the inner surface 20*c* of the lid 20 nearer to the rear end portion 20*a*. Each of the fourth pivotally-support portion 535 and the sixth pivotally-support portion 545 may be disposed at any position other than those described in the illustrated embodiments, as long as each of the fourth pivotally-support portion 535 and the sixth pivotally-support portion 545 is disposed at the corresponding one of the opposite end portions 20*d* of the lid 20 in the width direction of the lid 20 (i.e., in the key arrangement direction). For instance, each of the fourth pivotally-support portion 535 and the sixth pivotally-support portion 545 may be disposed at a position in the inner surface 20*c* of the lid 20 intermediate between the rear end portion 20*a* and the front end portion 20*b*, a position in the end face 20*e* of the lid 20 at the rear end portion 20*a*, or a position in the end face 20*e* of the lid 20 intermediate between the rear end portion 20*a* and the front end portion 20*b*.

In the illustrated fifth and sixth embodiments, the portions of the inner surface 20*c* of the lid 20 corresponding to the opposite end portions 20*d*, 20*d* of the lid 20 in the width direction of the lid 20 are configured to be placed on the upper end faces 6*a*, 6*a* of the side plates 6, 6 when the lid 20 is located at the closed position. While not shown, members for resting the lid thereon (lid rest members) may be attached to the inner side surfaces 6*c*, 6*c* of the side plates 6, 6, and the portions of the inner surface 20*c* of the lid 20 corresponding to the opposite end portions 20*d*, 20*d* of the lid 20 in the width direction of the lid 20 may be placed on upper end faces of the respective lid rest members when the lid 20 is located at the closed position. In this instance, each lid rest member may be attached to the inner side surface 6*a* of a corresponding one of the side plates 6, such that an upper end face of the lid rest member is parallel to the upper end face 6*a* of the side plate 6 and such that the upper end face of the lid rest member is located at a height position lower than the upper end face 6*a* of the side plate 6 by an amount corresponding to the thickness of the lid 20. According to the arrangement, the outer surface (the upper surface) of the lid 20 which is located at the closed position can be made flush with the upper end face 6*a* of the side plate 6, namely, can be disposed in one continuous plane at the same height position. Therefore, it is possible to enhance an appearance of the keyboard musical instrument in the state in which the lid 20 is closed.

In the illustrated fifth and sixth embodiments, each attachment plate 534 by which the fourth pivotally-support portion 535 and the sixth pivotally-support portion 545 are supported is attached to the inner surface 20*c* of the lid 20. While not shown, an attachment plate, in place of the attachment plate 534, may be attached to an end face (outer side surface) of the lid 20 in the width direction of the lid 20 (i.e., the key arrangement direction), instead of the inner surface 20*c* of the lid 20. In this instance, the attachment plate may be configured to be accommodated in a clearance between the end face of the lid 20 in the width direction of the lid 20 and the inner side surface 6*c* of the side plate 6 facing the end face of the lid 20. Alternatively, the end face of the lid 20 in the width direction of the lid 20 may be slightly recessed, and the attachment plate may be fixed in the recessed portion, whereby the attachment plate does not interfere with the side plate 6 and the lid 20 located at the closed position. Further, a stepped portion may be formed at the end face of the lid 20 in the width direction of the lid 20, such that an inner-surface-side portion of the end face of the lid 20 is recessed inwardly in the width direction, as compared with an outer-surface-side portion of the end face of the lid 20, and the attachment plate may be disposed in the recessed or stepped portion. In this arrangement, an end part (end face) of the attachment plate is not exposed to the outer surface of the lid 20 (the upper surface) in the state in which the lid 20 is located at the closed position. Accordingly, it is possible to enhance an appearance of the keyboard musical instrument in the state in which the lid 20 is closed.

What is claimed is:

1. A lid opening/closing mechanism for a keyboard musical instrument, comprising:

a main body including a casing and a keyboard disposed in the casing and having a plurality of keys;

a plate-like lid attached to the casing so as to be movable between a closed position at which the lid is closed so as to cover the keyboard and an open position at which the lid is opened so as to uncover the keyboard; and a connecting mechanism for connecting a side wall portion disposed on one side of the keyboard in the casing and an end portion of the lid which is located at an end of the lid in a key arrangement direction in which the plurality of keys are arranged, the end portion being opposed to the side wall portion, wherein the connecting mechanism is configured such that, during a movement of the lid from the closed position to the open position, a rear end portion of the lid slidingly moves only in a direction from a rear end portion of the main body toward a front end portion thereof or moves in the direction from the rear end portion of the main body toward the front end portion thereof and in an upward direction.

2. The lid opening/closing mechanism according to claim 1, wherein the connecting mechanism includes:

a connecting member formed of a long plate and having one end which is pivotally supported by a first pivotally-support portion provided at the side wall portion and the other end which is pivotally supported by a second pivotally-support portion provided at the end portion of the lid; and a slide mechanism configured such that, during the movement of the lid from the closed position to the open position, the rear end portion of the lid slidingly moves in a front-rear direction of the main body, wherein the slide mechanism is configured such that, during the movement of the lid from the closed position to the open position, the rear end portion of the lid slidingly moves in the direction from the rear end portion of the main body toward the front end portion thereof in a longitudinal direction of the plurality of keys.

3. The lid opening/closing mechanism according to claim 2, wherein the second pivotally-support portion is provided on an inner surface of the lid facing the keyboard, at the end portion of the lid.

4. The lid opening/closing mechanism according to claim 2, wherein the first pivotally-support portion is provided at a position nearer to the front end portion of the main body than the second pivotally-support portion.

5. The lid opening/closing mechanism according to claim 2, comprising, each as the side wall portion, a pair of side walls which are disposed on one and the other of opposite sides of the keyboard in the casing, wherein the connecting mechanism includes, each as the connecting member, a pair of connecting members each of which connects a corresponding one of the side walls and a corresponding one of end portions of the lid which are located at one and the other of opposite ends of the lid in the key arrangement direction, and wherein the slide mechanism is configured such that the rear end portion of the lid that is separably in contact with upper end faces of the respective side walls slides on the upper end faces.

6. The lid opening/closing mechanism according to claim 2, further comprising a stopper portion configured to stop the movement of the lid by coming into contact with the connecting member, in a state in which the lid is located at the open position, wherein the lid located at the open position is disposed above the main body in an inclined state in which the rear end portion of the lid is located more frontward than a front end portion of the lid in the front-rear direction.

7. The lid opening/closing mechanism according to claim 6, wherein the stopper portion is configured such that, by coming into contact with the connecting member, the stopper portion limits the movement of the lid in the direction from the front end portion of the main body toward the rear end portion thereof and limits the movement of the lid in the upward direction.

8. The lid opening/closing mechanism according to claim 2, wherein the slide mechanism includes: a concave portion which is provided at one of the side wall portion and the lid and which extends in the front-rear direction of the main body; and a convex portion which is provided at the other of the side wall portion and the lid, the convex portion being configured to be slidably fitted in the concave portion.

9. The lid opening/closing mechanism according to claim 2, further comprising a force applying portion provided between the connecting member and the main body, the force applying portion being configured to apply, to the lid, a force in a direction in which the lid is moved from the closed position to the open position.

10. The lid opening/closing mechanism according to claim 2, further comprising a resistance-force generating portion provided at at least one of the first pivotally-support portion and the second pivotally-support portion, the resistance-force generating portion being configured to generate a resistance force against relative rotation between the main body and the connecting member or between the lid and the connecting member.

11. The lid opening/closing mechanism according to claim 8, further comprising a resistance-force generating portion provided between the concave portion and the convex portion, the resistance-force generating portion being configured to generate a resistance force against relative rotation between the main body and the connecting member or between the lid and the connecting member.

12. The lid opening/closing mechanism according to claim 1, wherein the connecting mechanism includes a first connecting member and a second connecting member respectively formed of long plates having mutually different lengths, the first connecting member and the second connecting member being disposed between the side wall portion and the end portion of the lid, wherein the first connecting member has one end which is pivotally supported by a third pivotally-support portion provided at the side wall portion and the other end which is pivotally supported by a fourth pivotally-support portion provided at the end portion of the lid, wherein the second connecting member has one end which is pivotally supported by a fifth pivotally-support portion provided at the side wall portion and the other end which is pivotally supported by a sixth pivotally-support portion provided at the end portion of the lid, wherein each of the third pivotally-support portion and the fifth pivotally-support portion is a pivot point which is provided at the side wall portion and whose relative position with respect to the main body is fixed while each of the fourth pivotally-support portion and the sixth pivotally-support portion is a pivot point which is provided at the lid and which is relatively displaceable with respect to the main body, and wherein the first connecting member and the second connecting member are configured such that, in the movement of the lid from the closed position to the open position, a locus of the fourth pivotally-support portion and a locus of the sixth pivotally-support portion intersect each other, and the rear end portion of the lid moves in the direction from the rear end portion of the main body toward the front end portion thereof.

13. The lid opening/closing mechanism according to claim 1, wherein the connecting mechanism includes a first connecting member and a second connecting member respectively formed of long plates having mutually different lengths, the first connecting member and the second connecting member being disposed between the side wall portion and the end portion of the lid, wherein the first connecting member has one end which is pivotally supported by a third pivotally-support portion provided at the side wall portion and the other end which is pivotally supported by a fourth pivotally-support portion provided at the end portion of the lid, wherein the second connecting member has one end which is pivotally supported by a fifth pivotally-support portion provided at the side wall portion and the other end which is pivotally supported by a sixth pivotally-support portion provided at the end portion of the lid, wherein each of the third pivotally-support portion and the fifth pivotally-support portion is a pivot point which is provided at the side wall portion and whose relative position with respect to the main body is fixed while each of the fourth pivotally-support portion and the sixth pivotally-support portion is a pivot point which is provided at the lid and which is relatively displaceable with respect to the main body, and wherein the first connecting member and the second connecting member are configured such that, in the movement of the lid from the closed position to the open position, a positional relationship between the fourth pivotally-support portion and the sixth pivotally-support portion in at least one of an up-down relation and a front-rear relation with respect to the main body is reversed, and the rear end portion of the lid moves in the direction from the rear end portion of the main body toward the front end portion thereof.

14. The lid opening/closing mechanism according to claim 1, wherein the connecting mechanism includes a first connecting member and a second connecting member respectively formed of long plates having mutually different lengths, the first connecting member and the second connecting member being disposed between the side wall portion and the end portion of the lid and, wherein the first connecting member has one end which is pivotally supported by a third pivotally-support portion provided at the side wall portion and the other end which is pivotally supported by a fourth pivotally-support portion provided at the end portion of the lid, wherein the second connecting member has one end which is pivotally supported by a fifth pivotally-support portion provided at the side wall portion and the other end which is pivotally supported by a sixth pivotally-support portion provided at the end portion of the lid, wherein each of the third pivotally-support portion and the fifth pivotally-support portion is a pivot point which is provided at the side wall portion and whose relative position with respect to the main body is fixed while each of the fourth pivotally-support portion and the sixth pivotally-support portion is a pivot point which is provided at the lid and which is relatively displaceable with respect to the main body, and wherein the first connecting member and the second connecting member are configured such that, during the movement of the lid from the closed position to the open position, a line that connects the third pivotally-support portion and the fourth pivotally-support portion which are respectively provided at the one end and the other end of the first connecting member and a line that connects the fifth pivotally-support portion and the sixth pivotally-support portion which are respectively provided at the one end and the other end of the second connecting member are always non-parallel to each other, and the rear end portion of the lid moves in the direction from the rear end portion of the main body toward the front end portion thereof.

15. The lid opening/closing mechanism according to claim 12, wherein the third pivotally-support portion and the fifth pivotally-support portion are disposed such that a position of the third pivotally-support portion and a position of the fifth pivotally-support portion in a front-rear direction of the main body are mutually different, and wherein the fourth pivotally-support portion and the sixth pivotally-support portion are disposed along a surface of the lid such that a position of the fourth pivotally-support portion and a position of the sixth pivotally-support portion in the front-rear direction are mutually different.

16. The lid opening/closing mechanism according to claim 12, further comprising a stopper portion configured to stop the movement of the lid in the direction from the rear end portion of the main body toward the front end portion thereof by coming into contact with at least one of the first connecting member and the second connecting member, in a state in which the lid is located at the open position, and wherein the lid located at the open position is disposed above the main body in an inclined state in which the rear end portion of the lid is located more frontward than a front end portion of the lid in the front-rear direction.

17. The lid opening/closing mechanism according to claim 6, further comprising: a panel surface disposed at a rear portion of the keyboard at an upper portion of the main body; and a plate-like music stand which is rotatably supported by a shaft portion provided on an inner surface of the lid and which is disposed so as to be opposed to the panel surface in a state in which the lid is located at the closed position, wherein the music stand is configured to be folded into a position along the inner surface of the lid such that a free end of the music stand comes into contact with the panel surface when the lid moves to the closed position.

18. The lid opening/closing mechanism according to claim 12, further comprising a force applying portion provided between: at least one of the first connecting member and the second connecting member; and the main body or the lid, the force applying portion being configured to apply, to the lid, a force in a direction in which the lid is moved from the closed position to the open position.

19. The lid opening/closing mechanism according to claim 12, further comprising a resistance-force generating portion provided between: at least one of the first connecting member and the second connecting member; and the main body or the lid, the resistance-force generating portion being configured to generate a resistance force against relative rotation between: the main body or the lid; and the first connecting member or the second connecting member.

20. The lid opening/closing mechanism according to claim 1, further comprising a concealment plate disposed at a position which is located at a rear portion of the keyboard and on a front side of the rear plate of the casing, wherein the concealment plate is disposed at a height position, in an up-down direction, higher than a connection of the side wall portion to which the one end of the connecting mechanism is connected, and wherein, when the lid is located at the closed position, a joint of the lid to which the other end of the connecting mechanism is joined is located at a height position, in the up-down direction, higher than the concealment plate and lower than the lid.

* * * * *